US006752481B1

(12) United States Patent
Takahashi et al.

(10) Patent No.: US 6,752,481 B1
(45) Date of Patent: Jun. 22, 2004

(54) INK JET RECORDING APPARATUS AND METHOD HAVING DOUBLE-SIDED RECORDING CAPABILITY

(75) Inventors: Seiji Takahashi, Yokohama (JP); Shinya Matsui, Hara-machi (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/359,713

(22) Filed: Jul. 23, 1999

(30) Foreign Application Priority Data

Jul. 30, 1998 (JP) ..... 10-215683

(51) Int. Cl.[7] ..... B41J 29/38
(52) U.S. Cl. ..... 347/9; 347/5; 358/1.12
(58) Field of Search ..... 347/9, 104, 5; 358/1.12, 2.1, 3.26; 355/23, 24; 399/309, 364, 29; 382/275

(56) References Cited

U.S. PATENT DOCUMENTS

| | | | | |
|---|---|---|---|---|
| 4,313,124 A | | 1/1982 | Hara | 347/57 |
| 4,345,262 A | | 8/1982 | Shirato et al. | 347/10 |
| 4,459,600 A | | 7/1984 | Sato et al. | 347/47 |
| 4,463,359 A | | 7/1984 | Ayata et al. | 347/56 |
| 4,558,333 A | | 12/1985 | Sugitani et al. | 347/65 |
| 4,608,577 A | | 8/1986 | Hori | 347/66 |
| 4,723,129 A | | 2/1988 | Endo et al. | 347/56 |
| 4,740,796 A | | 4/1988 | Endo et al. | 347/56 |
| 5,610,634 A | * | 3/1997 | Murata et al. | 347/5 |
| 5,742,301 A | * | 4/1998 | Ikeda | 347/9 |
| 5,745,145 A | * | 4/1998 | Hirabayashi et al. | 347/183 |
| 5,761,573 A | * | 6/1998 | Haneda et al. | 399/66 |
| 5,832,137 A | * | 11/1998 | Knox | 382/275 |
| 5,907,666 A | | 5/1999 | Yano et al. | 395/109 |

FOREIGN PATENT DOCUMENTS

| | | | |
|---|---|---|---|
| JP | 54-056847 | 5/1979 | B41M/5/26 |
| JP | 59-123670 | 7/1984 | B41J/3/04 |
| JP | 59-138461 | 8/1984 | B41J/3/04 |
| JP | 60-071260 | 4/1985 | B41J/3/04 |
| JP | 6-134982 | 5/1994 | B41J/2/01 |
| JP | 7-314734 | 12/1995 | B41J/2/205 |
| JP | 40817491 A * | 7/1996 | B41J/5/30 |

* cited by examiner

*Primary Examiner*—Stephen D. Meier
*Assistant Examiner*—Alfred Dudding
(74) *Attorney, Agent, or Firm*—Fitzpatrick, Cella, Harper & Scinto

(57) ABSTRACT

An ink jet recording apparatus and method subjects recording data to conversion, for example, thinning, when the recording data is not text data and a double-sided recording mode is selected. By effecting recording based on this recording data, recording quality is prevented from being reduced due to ink spread and thinning.

58 Claims, 21 Drawing Sheets

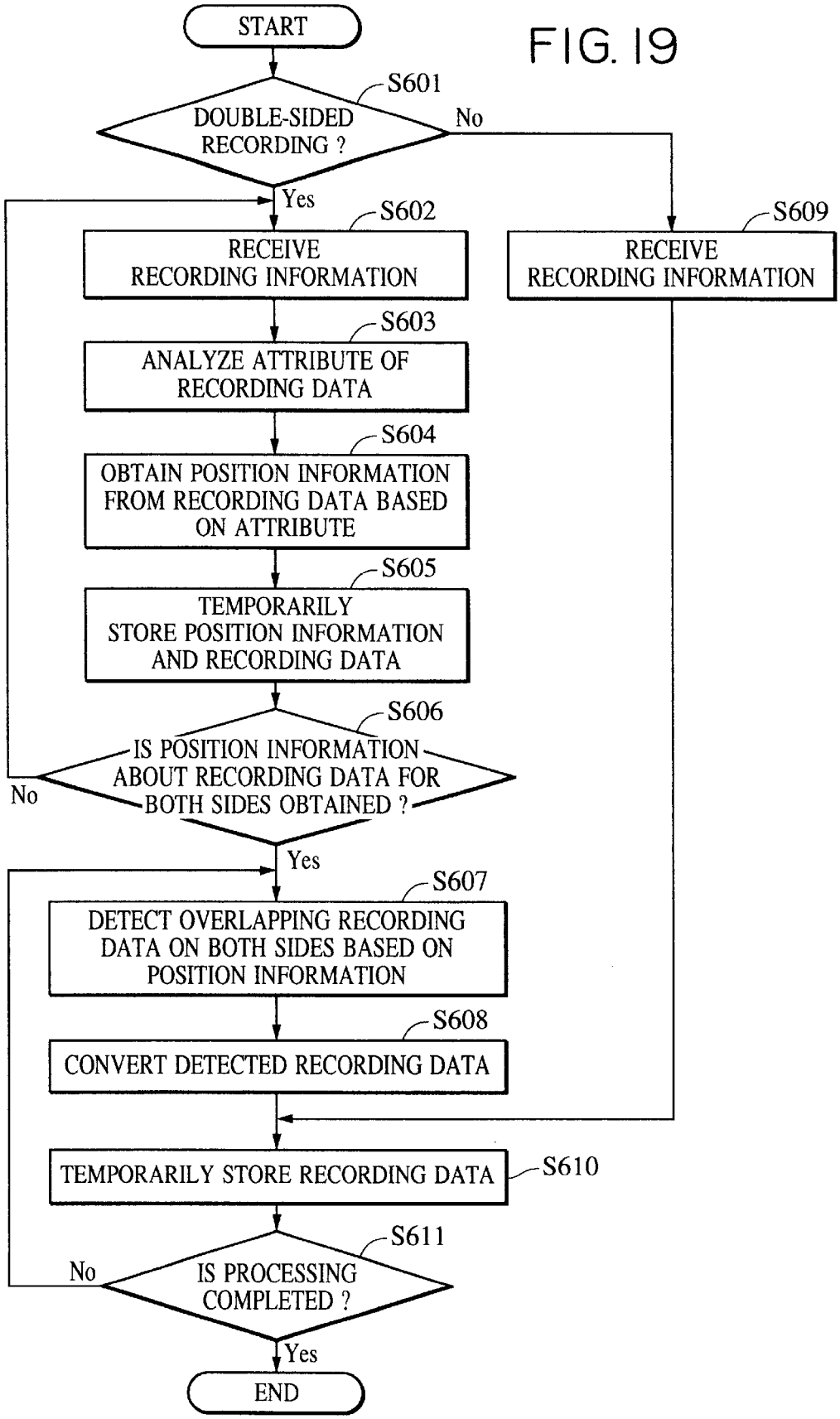
FIG. 19
START
S601
DOUBLE-SIDED RECORDING ?
No
Yes
S602
RECEIVE RECORDING INFORMATION
S603
ANALYZE ATTRIBUTE OF RECORDING DATA
S604
OBTAIN POSITION INFORMATION FROM RECORDING DATA BASED ON ATTRIBUTE
S605
TEMPORARILY STORE POSITION INFORMATION AND RECORDING DATA
S606
IS POSITION INFORMATION ABOUT RECORDING DATA FOR BOTH SIDES OBTAINED ?
No
Yes
S607
DETECT OVERLAPPING RECORDING DATA ON BOTH SIDES BASED ON POSITION INFORMATION
S608
CONVERT DETECTED RECORDING DATA
S609
RECEIVE RECORDING INFORMATION
TEMPORARILY STORE RECORDING DATA
S610
S611
IS PROCESSING COMPLETED ?
No
Yes
END

INK JET RECORDING APPARATUS AND METHOD HAVING DOUBLE-SIDED RECORDING CAPABILITY

BACKGROUND OF THE INVENTION

1. Field of the Invention

The present invention relates to a recording apparatus, such as a printer, for use in general business machines, and more particularly, to an ink jet recording apparatus that effects recording by discharging ink based on desired recording data and that has a double-sided recording capability.

2. Description of the Related Art

Printers are well known as recording apparatuses for recording desired recording information, such as characters and images, on a recording medium, such as a sheet or a film. Information processing apparatuses, such as word processors and personal computers, for creating and editing recording information have remarkably increased in performance, and furthermore, the variety of information input apparatuses, such as scanners, video capture devices, CD-ROM drives, and digital cameras, has increased. With such circumstances of the information processing apparatuses and information input apparatuses as a background, the variety of applications of recording apparatuses, such as printers, has also increased. For example, printers are sometimes used like conventional copying machines so as to record from a single source of recording information (a document) onto a plurality of media. The number of records made by recording apparatuses, such as printers, will tend to increase further in future.

As is well known, recording apparatuses include a serial type recording apparatus in which a recording medium, such as a sheet of paper, is fed and in which a recording head is mounted on a movable section, such as a carriage that reciprocates perpendicularly to the feeding direction, and a line type recording apparatus having a recording head of a length corresponding to the width of the recording medium. Known recording methods are wire dot printing, thermal printing, thermal transfer printing, ink jet printing, electrophotography, and the like. Among these methods, the ink jet method offers low running costs, reduces noise because it is a non-impact method, and allows easy color recording using inks of multiple colors. For these reasons, recording apparatuses of the ink jet type have outstandingly become widespread.

In recent years, importance has been attached to recording on both sides of a recording medium, such as a sheet, in the recording apparatus from the viewpoint of efficient use of recording media, such as paper, for the purpose of resource conservation. Various structures for recording on both sides of a recording medium in the recording apparatus have been proposed.

In the ink jet method, however, since desired recording is made by discharging liquid ink from a recording head onto a recording medium, such as a sheet, the following problem arises in double-sided recording. That is, ink permeates to the back side opposite from the recorded side, depending on the characteristic of the recording medium, the characteristic of the ink, and the duty of a recorded image. This may degrade recording quality; that is, a record on the back side is not clear, or, in color recording, the tone or the like of the recorded result on one side is substantially different from the desired one due to the influence of the recorded result on the other side.

FIG. 21 schematically shows a state in which ink discharged from a recording head adheres to and permeates through a recording medium, such as a sheet, and spreads in double-sided recording. When a discharged ink droplet adheres to one side of the recording medium, it spreads thereon. The ink droplet also permeates in the bulk direction of the recording medium, and is fixed. Subsequently, an ink droplet is discharged onto the other side for double-sided recording, and permeates in the bulk direction of the recording medium. In some cases, the ink that has permeated one side and the newly permeated ink mingle, thereby reducing recording quality.

In order to solve the above problem, the present applicant has proposed that a standby time before starting recording on the back side be controlled, or that recording density in double-sided recording be made lower than that in single-sided recording (see Japanese Laid-Open Patent Application Nos. 134982/1994 and 314734/1995 and U.S. Pat. No. 5,742,301). In the former method, however, throughput is reduced depending on the standby time. In the latter method, recording density is simply lowered in double-sided recording, and recording data for lowering recording density is not described in detail. For this reason, recording quality is sometimes reduced, depending on the type of recording data to be recorded.

SUMMARY OF THE INVENTION

The present invention has been made in view of the problems of the above-described conventional arts, and it is accordingly an object of the present invention to provide an ink jet recording apparatus that achieves good double-sided recording without reducing throughput.

According to an aspect of the present invention, there is provided an ink jet recording apparatus in which ink is discharged from a recording head onto a recording medium based on recording data so as to record on one side of the recording medium and to also record on the other side of the recording medium. The ink jet recording apparatus includes a conversion means for converting at least a part of the recording data, a detection means for detecting recording data to be converted by the conversion means based on recording information including the recording data and an attribute of the recording data, and a control means for controlling recording based on the recording data converted by the conversion means according to the result of detection by the detection means.

According to another aspect of the present invention, there is provided an ink jet recording method in which ink is discharged from a recording head onto a recording medium based on recording data to record on one side of the recording medium and to also record on the other side of the recording medium. The ink jet recording method includes the steps of converting at least a part of the recording data, detecting recording data to be converted in the conversion step based on recording information including the recording data and an attribute of the recording data, and controlling recording based on the recording data converted in the conversion step according to the detection result in the detection step.

According to yet another aspect of the present invention, there is provided an ink jet recording apparatus in which ink is discharged from a recording head onto a recording medium based on recording data so as to record on one side of the recording medium and to also record on the other side of the recording medium. The ink jet recording apparatus includes a printer driver and a microprocessor. The printer driver detects recording data to be converted based on recording information including the recording data and an attribute of the recording data. The printer driver converts the detected recording data. The microprocessor controls recording based on the recording data converted by the printer driver according to the result of detection by the printer driver.

Further objects, features, and advantages of the present invention will become apparent from the following description of the preferred embodiments with reference to the attached drawings.

BRIEF DESCRIPTION OF THE DRAWINGS

FIG. 19 is a flowchart showing recording data processing in a double-sided recording mode according to a second embodiment of the present invention;

DESCRIPTION OF THE PREFERRED EMBODIMENTS

First Embodiment

A recording apparatus according to a first embodiment of the present invention will be described below with reference to the attached drawings. In this embodiment, a serial type ink jet recording apparatus will be described as an example.

Figure 1:
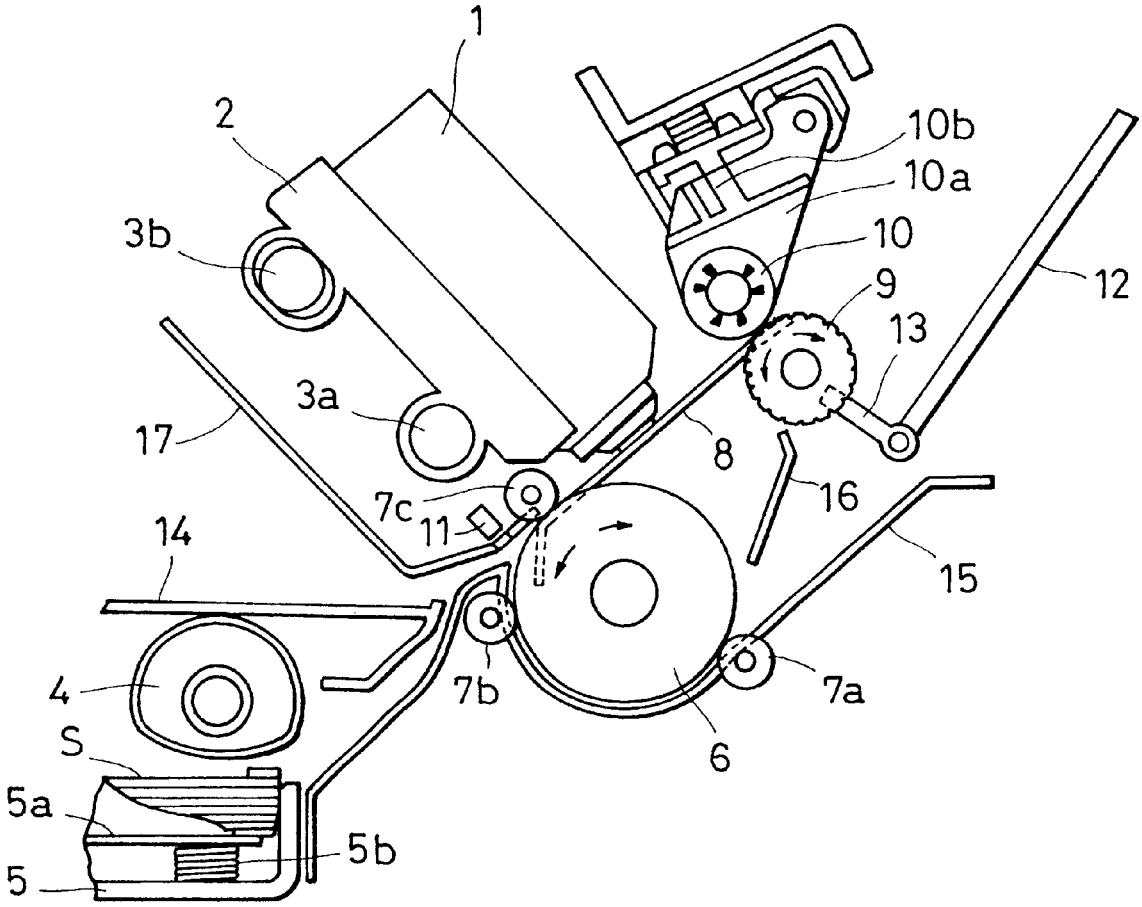
FIG. 1 is a schematic sectional view showing the configuration of an ink jet recording apparatus according to a first embodiment of the present invention.

FIG. 1 is a schematic sectional view showing the configuration of an ink jet recording apparatus according to the first embodiment of the present invention. As shown in FIG. 1, the recording apparatus of this embodiment has a recording head 1 of an ink jet recording type that performs recording by discharging ink. That is, the recording head 1 includes liquid discharging outlets (orifices), liquid flow paths, an energy acting portion provided in a part of each of the liquid flow paths, and an energy generating device for generating liquid droplet forming energy that acts on the liquid in the acting portion, e.g., a heater serving as an electrothermal transducer.

While the ink jet recording apparatus of this embodiment makes monochrome recording as an example, of course, the present invention is also applicable to a color ink jet recording apparatus having recording heads corresponding to four colors.

The recording head 1 is detachably held on a carriage 2. The carriage 2 is slidably supported by a lead screw 3*a* and a cylindrical carriage shaft 3*b* that extend in the direction intersecting the feeding direction of a sheet S (the direction orthogonal thereto in the embodiment: a main scanning direction). The lead screw 3*a* has a helical groove (not shown), and is engaged with a part of the carriage 2. Therefore, when the lead screw 3*a* is rotated by rotating a drive means (not shown), the carriage 2 with the recording head 1 mounted thereon reciprocates along the carriage shaft 3*b* in the main scanning direction.

Above a sheet feed stacker 5 that serves as a support member for supporting recording sheets S, a delivery roller 4 shaped like a semicircle in profile is placed to pick up and deliver the recording sheets S on the sheet feed stacker 5. The sheet feed stacker 5 is provided with a pressure plate 5*a* for bearing a stack of recording sheets S thereon. The pressure plate 5*a* is urged upward by a pressure plate spring 5*b* from the back side, and is brought into contact with the topmost recording sheet S when the delivery roller 4 is turned. While the sheet feed stacker 5 for bearing a plurality of stacked recording sheets is used in this embodiment, it may be replaced with a member for supporting a single recording sheet, such as a manual feeding tray.

A feed roller 6 is disposed above the sheet feed stacker 5 so as to be rotated by a drive means in forward and reverse directions shown by the arrows of FIG. 1. The feed roller 6 holds and conveys a recording sheet S in the sub-scanning direction (the direction orthogonal to the main scanning direction). Driven rollers 7*a*, 7*b*, and 7*c* press the recording sheet S against the feed roller 6, thereby producing feeding force.

Opposed to the recording head 1, a paper guide (platen plate) 8 is disposed to define the position where the recording sheet S is subjected to recording (recording section: sheet processing section). Between the recording head 1 and the surface of the paper guide 8, a small clearance is formed to pass the recording sheet S therethrough.

An ejection roller 9 is disposed above the recording head 1 so as to be rotated by a drive means (not shown) in forward and reverse directions shown by the arrows of FIG. 1. The ejection roller 9 conveys and ejects a recording sheet that has been subjected to recording. A driven roller 10 is placed adjacent to the ejection roller 9. Both the rollers 9 and 10 are in pressure contact with each other so as to nip and convey the recording sheet. The driven roller 10 is rotatably supported by a support member 10*a* that is urged by a pressure spring 10*b*, and is in pressure contact with the ejection roller 9.

A sheet sensor 11 is placed below the recording head 1 so as to detect the leading and rear ends of a recording sheet S to be conveyed to the recording head 1. The sheet sensor 11 is disposed upstream from the contact point between the feed roller 6 and the driven roller 7*c* in the sheet feeding direction. In this embodiment, a reflective photosensor is used as the sheet sensor 11.

Above the ejection roller 9, a holding tray 12 serving as an intermediate holding member is disposed to temporarily hold a recording sheet S with one side thereof recorded, and has a bottom plate 13 that can be opened and closed. The holding tray 12 is inclined so as to receive the lower side (unrecorded side) of a recording sheet S discharged from the feed roller 6. The recording sheet S ejected onto the holding tray 12 slips down along the inclination, and is held with its bottom end in contact with the bottom plate 13 of the holding tray 12. Separately from the holding tray 12, an ejection tray 14 is disposed below the recording head 1 so as to serve as a receiving member for holding recording sheets S with both sides thereof recorded.

Below the holding tray 12, guide plates 15 and 16 define a feeding path for guiding a recording sheet S, which falls off the holding tray 12 when the bottom plate 13 is opened, to the feed roller 6 again. A guide plate 17 is also disposed above the ejection tray 14.

Figure 2:
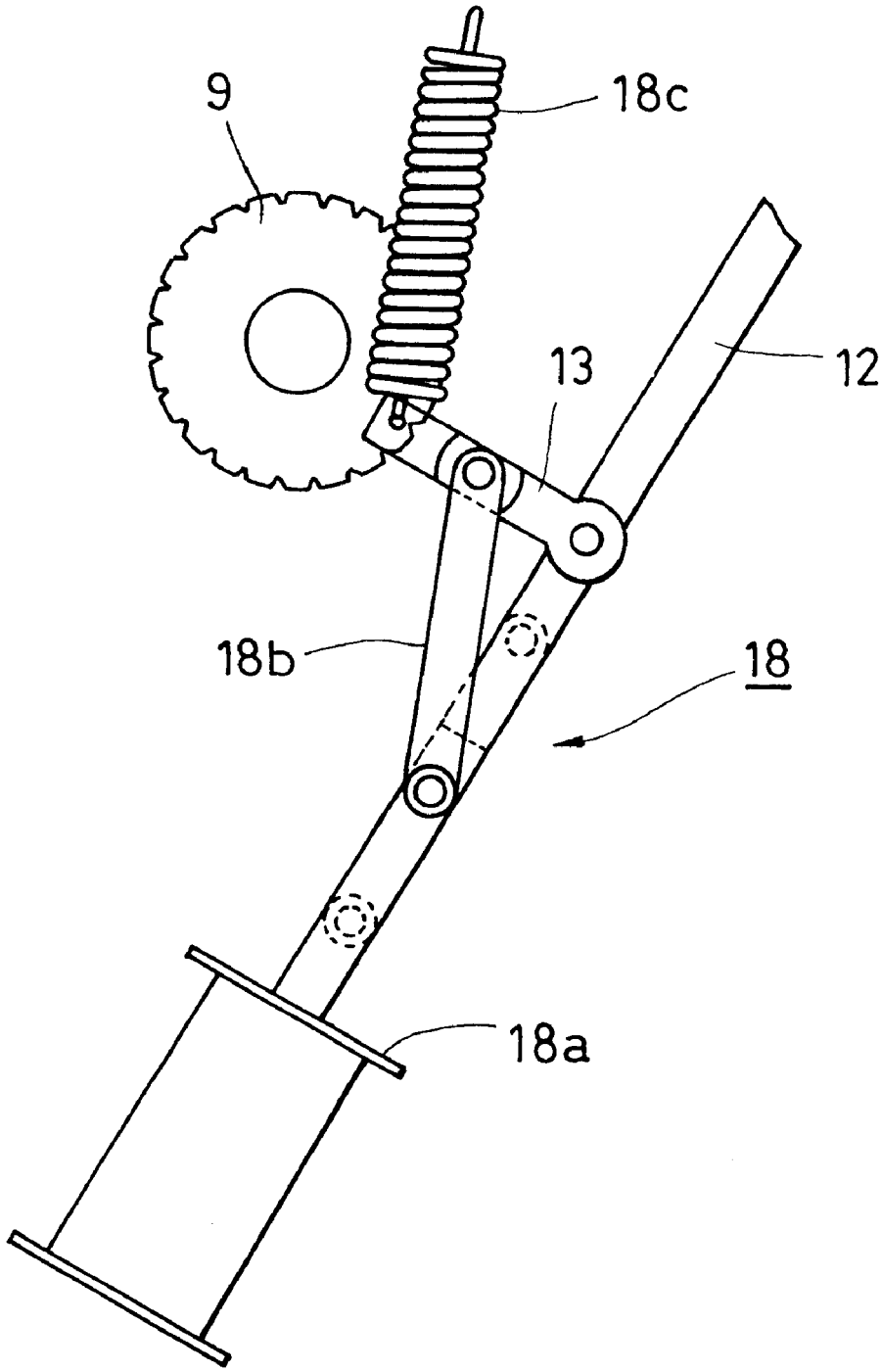
FIG. 2 is a schematic structural view of a bottom plate opening and closing mechanism in the ink jet recording apparatus.

An opening and closing mechanism 18 for opening and closing the bottom plate 13 comprises, as shown in FIG. 2, a solenoid 18*a* to be electrically energized and de-energized, a lever 18*b* for connecting the bottom plate 13 and the solenoid 18*a*, and a spring 18*c* for pulling the bottom plate 13 in the closing direction. Therefore, when the solenoid 18*a* is in the off-state, the bottom plate 13 is closed by the force of the spring 18*c*. In contrast, when the solenoid 18*a* is energized, the lever 18*b* is pulled down against the force of the spring 18*c*, thereby opening the bottom plate 13. When the solenoid 18*a* is de-energized again, the bottom plate 13 is closed because of the force of restitution of the spring 18*c*.

Figure 3:
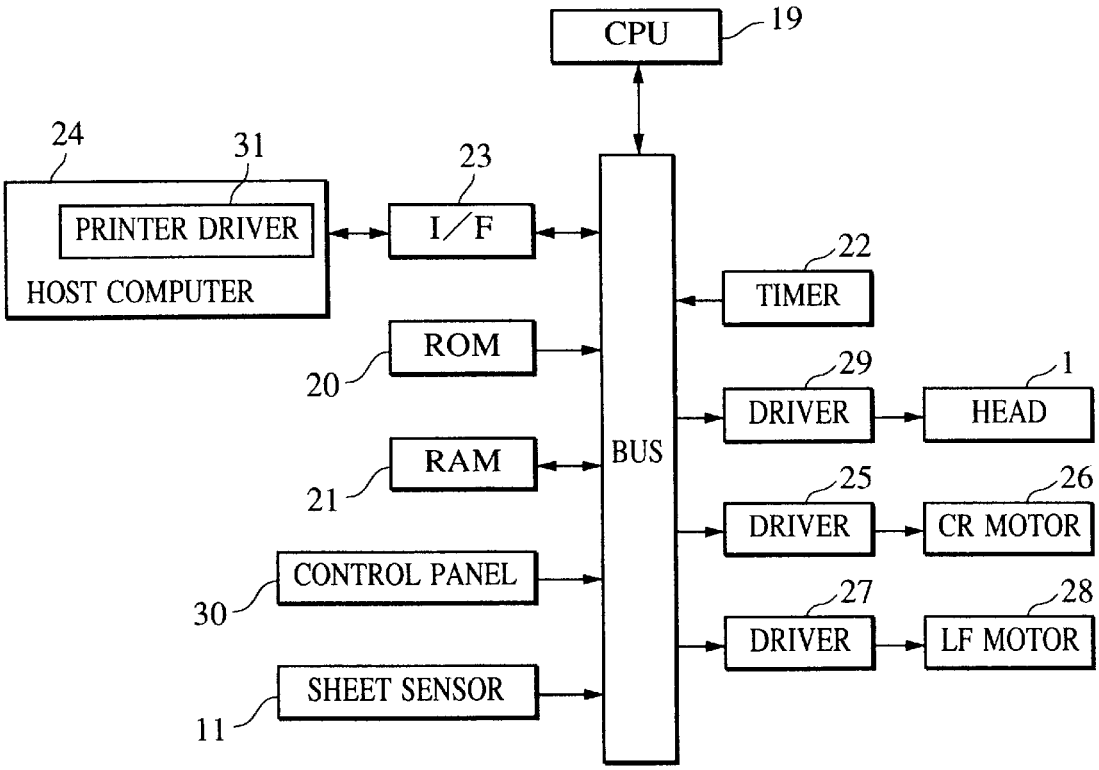
FIG. 3 is a block diagram of a control system in the ink jet recording apparatus.

Next, a description will be given of the configuration of a control system in the recording apparatus of this embodiment. FIG. 3 is a block diagram showing the configuration of the control system. The control system includes a CPU 19 in the form of a microprocessor. The CPU 19 reads programs and various data out of a ROM 20, a RAM 21, and the like, which will be described later, makes necessary calculations and determinations, and outputs various control signals according to a control program, thereby controlling the drive of the entire apparatus. The ROM 20 is a program memory in which various programs and data for operating the CPU 19 are stored. The RAM 21 is a buffer memory, and includes a working area for temporarily storing data on commands from the CPU 19 and calculation results, a text area for storing various data, and the like. Connected to the CPU 19 via a data bus is a timer 22 that measures time based on command signals from the CPU 19, and that outputs time information.

The CPU 19 is electrically connected to a host computer 24 via an interface 23, and controls a recording operation based on recording data from the host computer 24 that is stored in the ROM 20 and the RAM 21. The host computer 24 is provided with a printer driver 31 that receives recording information created and edited in the computer and that delivers the recording information to the recording apparatus via the interface 23. The printer driver 31 also allows setting and selection of various information about recording by the recording apparatus, and delivers the set and selected information to the recording apparatus.

The general structure of the printer driver 31 installed in the host computer 24 is described in U.S. Pat. No. 5,907,666, the contents of which are incorporated by reference into the specification.

Such information about recording includes, for example, the setting of the type of a recording medium to be recorded, such as a sheet, and the choice between a single-sided recording mode and a double-sided recording mode. In this embodiment, the printer driver 31 also serves to convert recording data in double-sided recording, which will be described later, and to detect data to be converted. The CPU 19 also controls a carriage (represented by "CR" in the figure) motor 26 and a feeding (represented by "LF" in the figure) motor 28 via motor drivers 25 and 27, and controls the recording head 1 via a head driver 29 according to recording information stored in the RAM 21. A control panel 30 for setting the recording states, such as a recording mode, and the above-described sheet sensor 11 for detecting the leading and rear ends of a recording sheet are connected to the CPU 19 via the data bus.

The RAM 21 serving as a buffer memory is a line buffer that stores recording data for one scan or a plurality of scans. The line buffer stores information about the position in the recording area where recording is made by the orifices of the recording head in one main scan.

Figure 4:
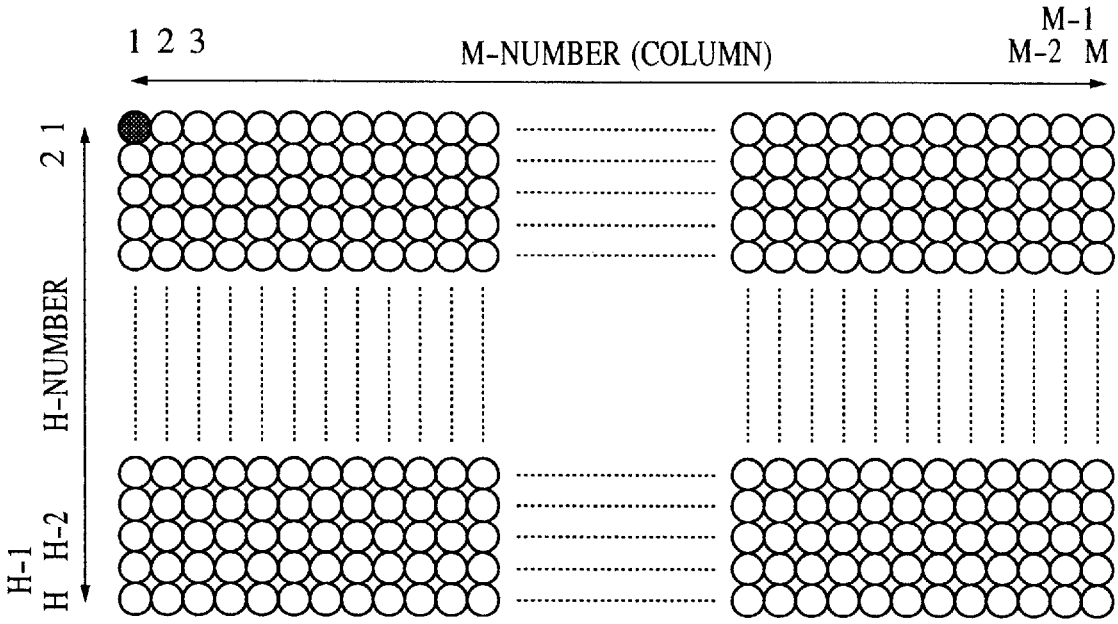
FIG. 4 is an explanatory illustration of a buffer memory in the ink jet recording apparatus.
Figure 5:
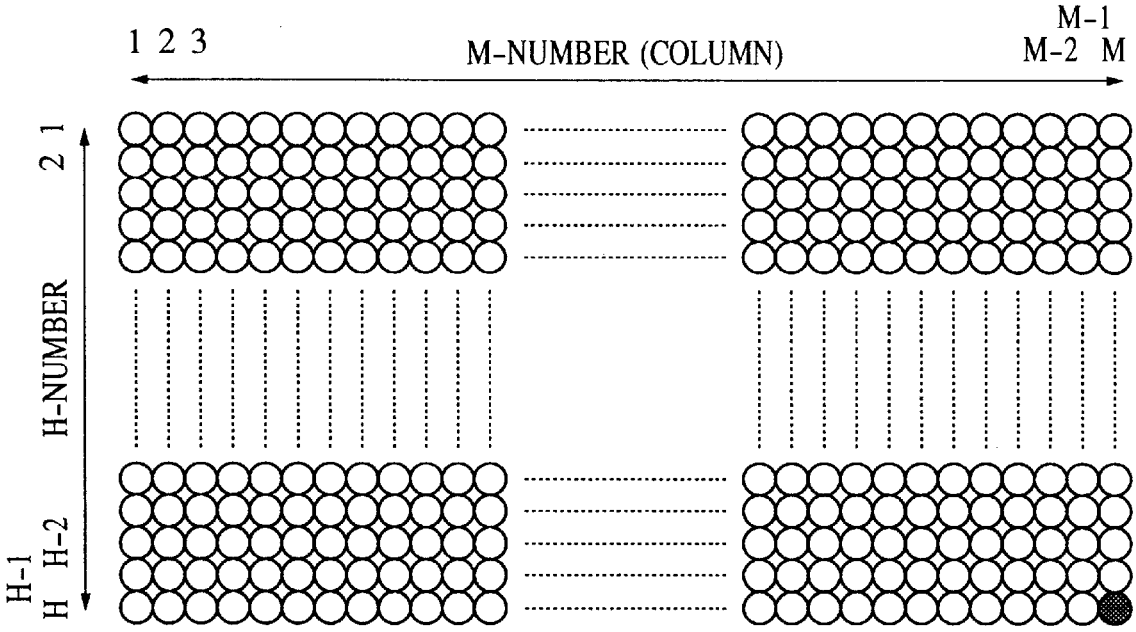
FIG. 5 is another explanatory illustration of the buffer memory in the ink jet recording apparatus.

FIGS. 4 and 5 show examples of states in which recording data is stored in the buffer of the RAM 21. The buffer is formed of a matrix of M number of columns necessary for expressing the maximum recording width of a recording sheet to be used in the recording apparatus with a predetermined dot pitch, and rows corresponding to the number of orifices of the recording head 1. When recording is made on the front side of a recording sheet, expanded recording data sent from the host computer 24 is stored from dot (filled dot) information in the first row and the first column of the buffer, as shown in FIG. 4. In contrast, when recording is made on the back side, recording data is stored from dot (filled dot) information in the H-th row and the M-th column of the buffer, as shown in FIG. 5. Recording data for the back side may be stored in the same order as in the case of the front side shown in FIG. 4. In this case, the order, in which the recording data is sent from the printer driver 31 shown in FIG. 3 to the recording apparatus, is reversed. The dots shown in FIG. 4 schematically represent dots to be expanded and recorded on the recording sheet, and each dot does not correspond to each item of recording data.

Next, a description will be given of the operation in a double-sided recording mode of the ink jet recording apparatus of this embodiment under the control of the control system having such a configuration. Recording data stored in the line buffer (RAM 21) for recording in the recording apparatus is subjected to a predetermined processing for double-sided recording in the printer driver 31, and is then delivered to the recording apparatus via the interface 23. The predetermined processing of this embodiment will be described later in detail.

Figure 6:
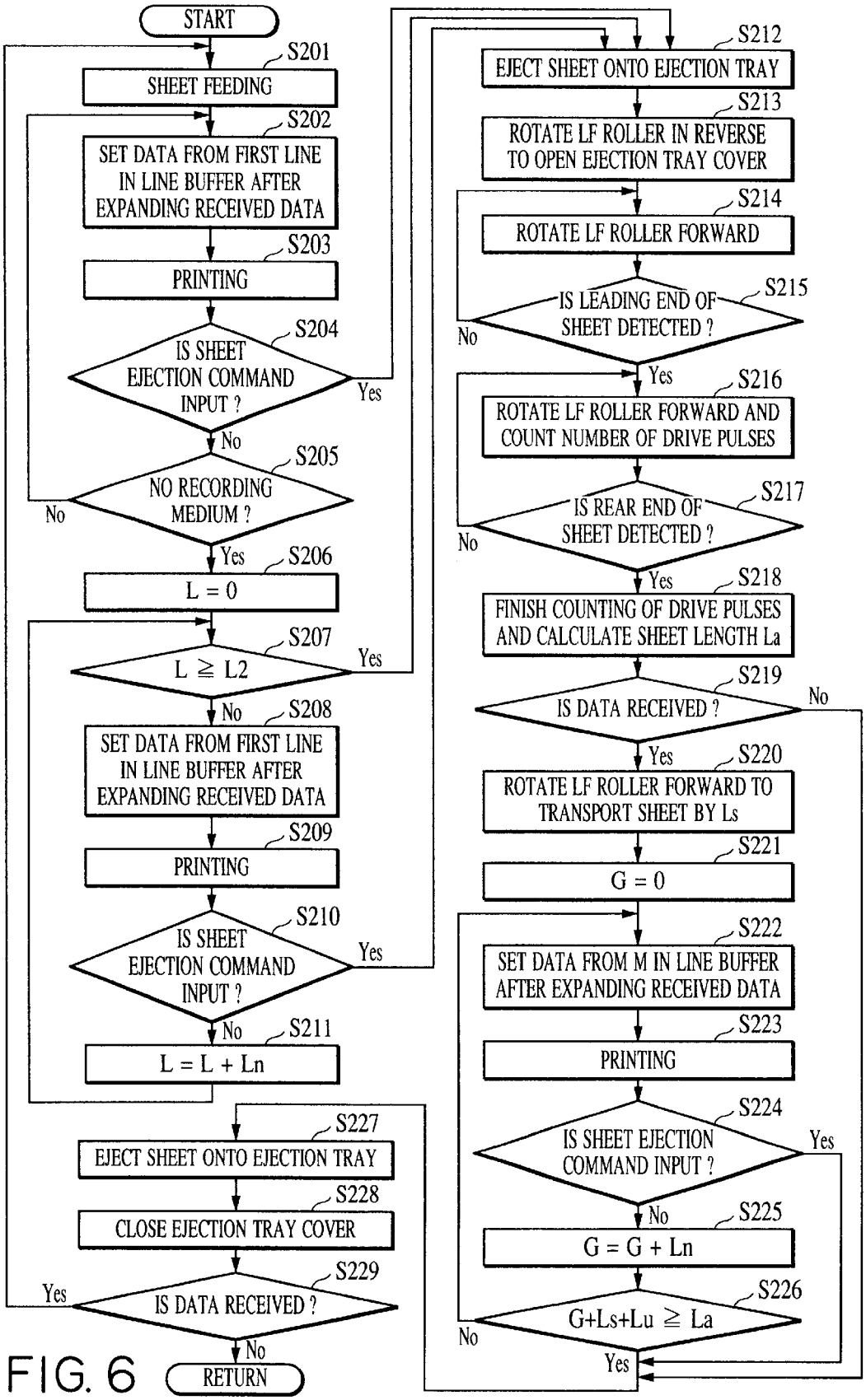
FIG. 6 is a flowchart showing the procedure of a double-sided recording mode according to the first embodiment.
Figure 7:
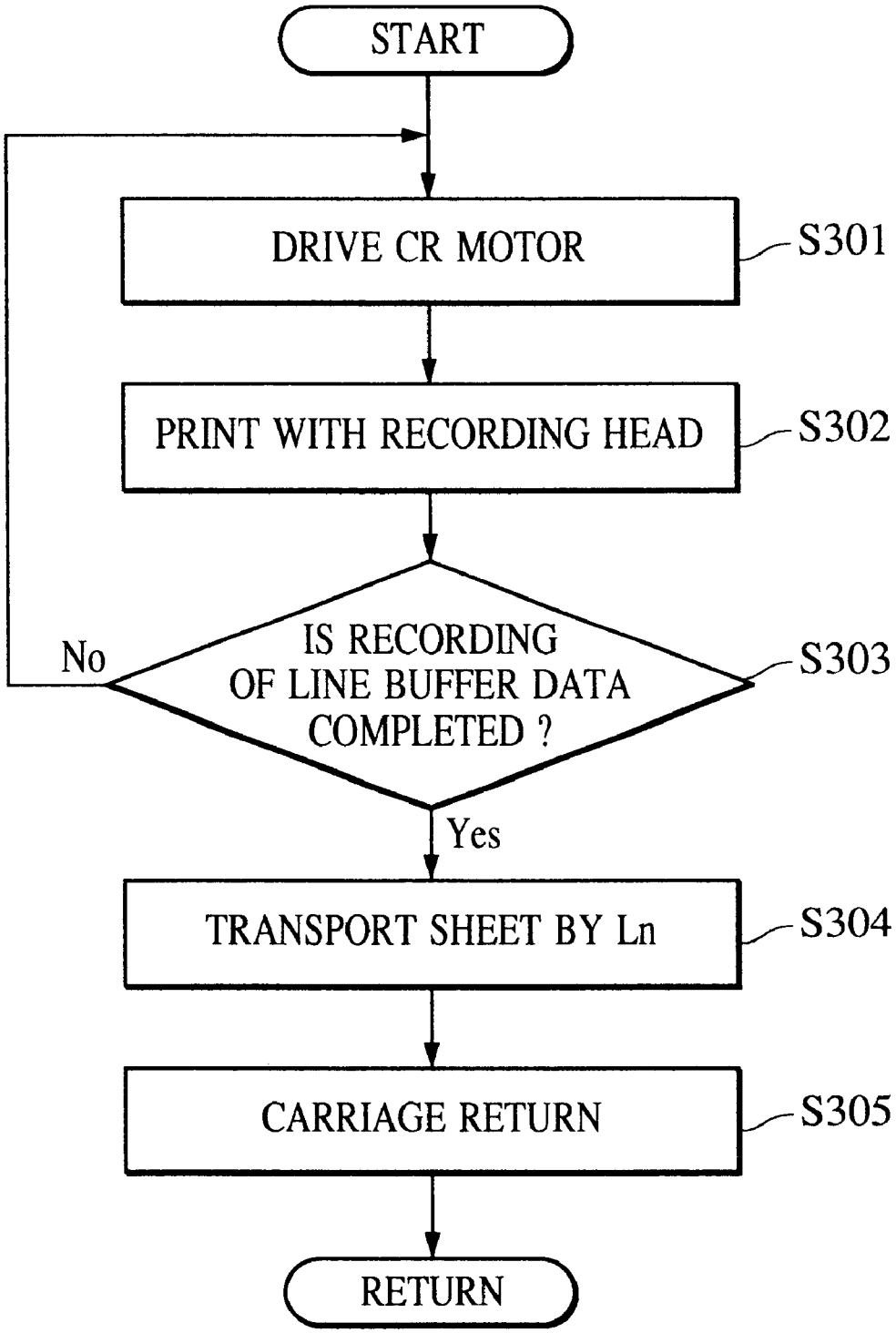
FIG. 7 is a flowchart showing a recording operation in the first embodiment.

FIG. 6 is a flowchart showing the procedure of a double-sided recording mode, FIG. 7 is a flowchart showing a recording operation, and FIGS. 8 to 15 are schematic sectional views of the recording apparatus, showing feeding states of a recording sheet therein.

Figure 8:
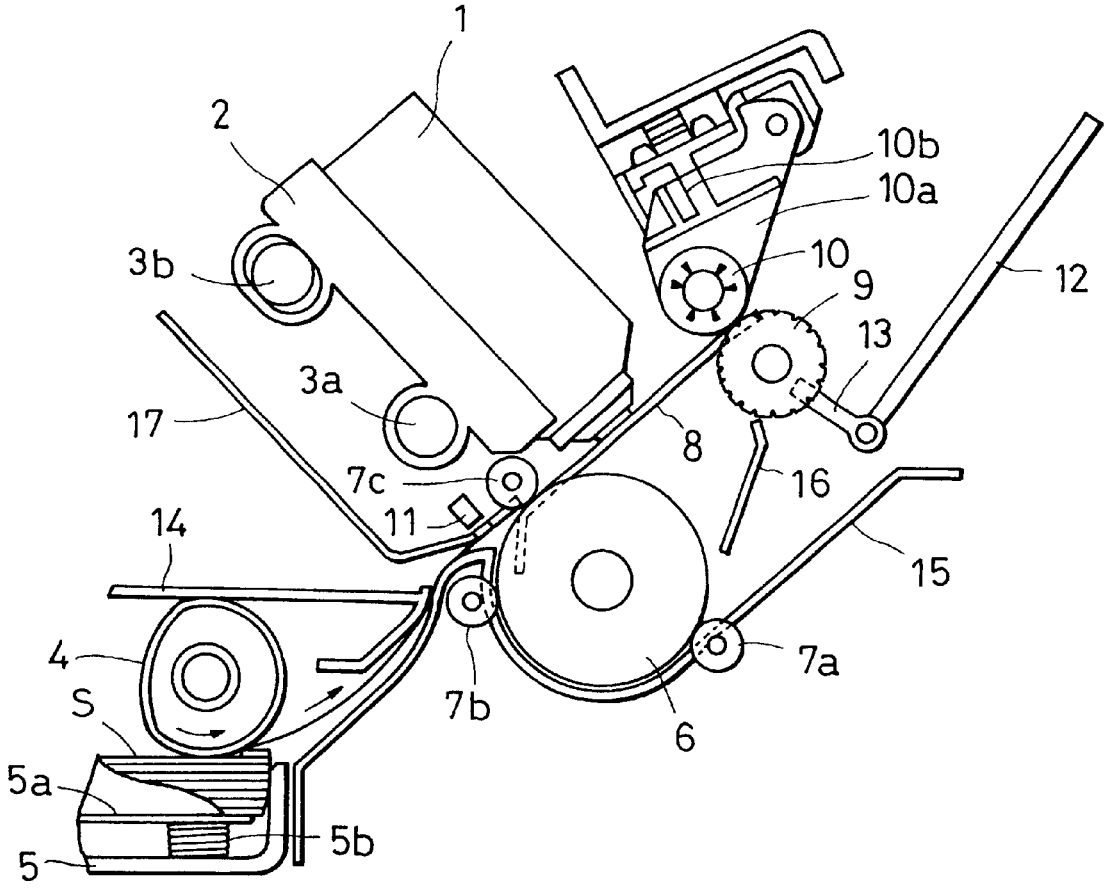
FIGS. 8 to 15 are schematic sectional views showing feeding states of a recording medium in the ink jet recording apparatus.

Referring to FIG. 6, when a recording start command is received from the host computer 24, the LF motor 28 drives forward to rotate the delivery roller 4, so that recording sheets S on the sheet feed stacker 5 are picked up and fed one by one, as shown in FIG. 8. Furthermore, the recording sheet S is conveyed by the feed roller 6 and the driven roller 7*c*, and is placed in a recording position (Step S201). Hereinafter, the leading end of the recording sheet S in the feeding direction in front side recording is referred to as the "top end", and the rear end in the feeding direction is referred to as the "bottom end".

Recording on the front side will be described below. After received data sent via the interface 23 is expanded as recording data, it is stored in the buffer described above (S202). Subsequently, a recording operation shown in FIG.

7 is carried out in Step S203. First, the CR motor 26 is driven forward and in reverse, the carriage 2 with the recording head 1 mounted thereon starts to perform main scanning (S301), and recording data in the line buffer is recorded on the recording sheet S from the first column by the recording head 1 (S302). At this time, the CPU 19 controls the drive of the driver 29 for the recording head 1 based on the recording data, and causes the recording head 1 to discharge ink for recording based on the recording data. When recording of data in the M-th column of the line buffer is completed (S303), the recording sheet S is conveyed by a predetermined amount Ln in the sub-scanning direction (S304). Then, the carriage 2 is returned to the main scanning start position (S305).

Figure 9:
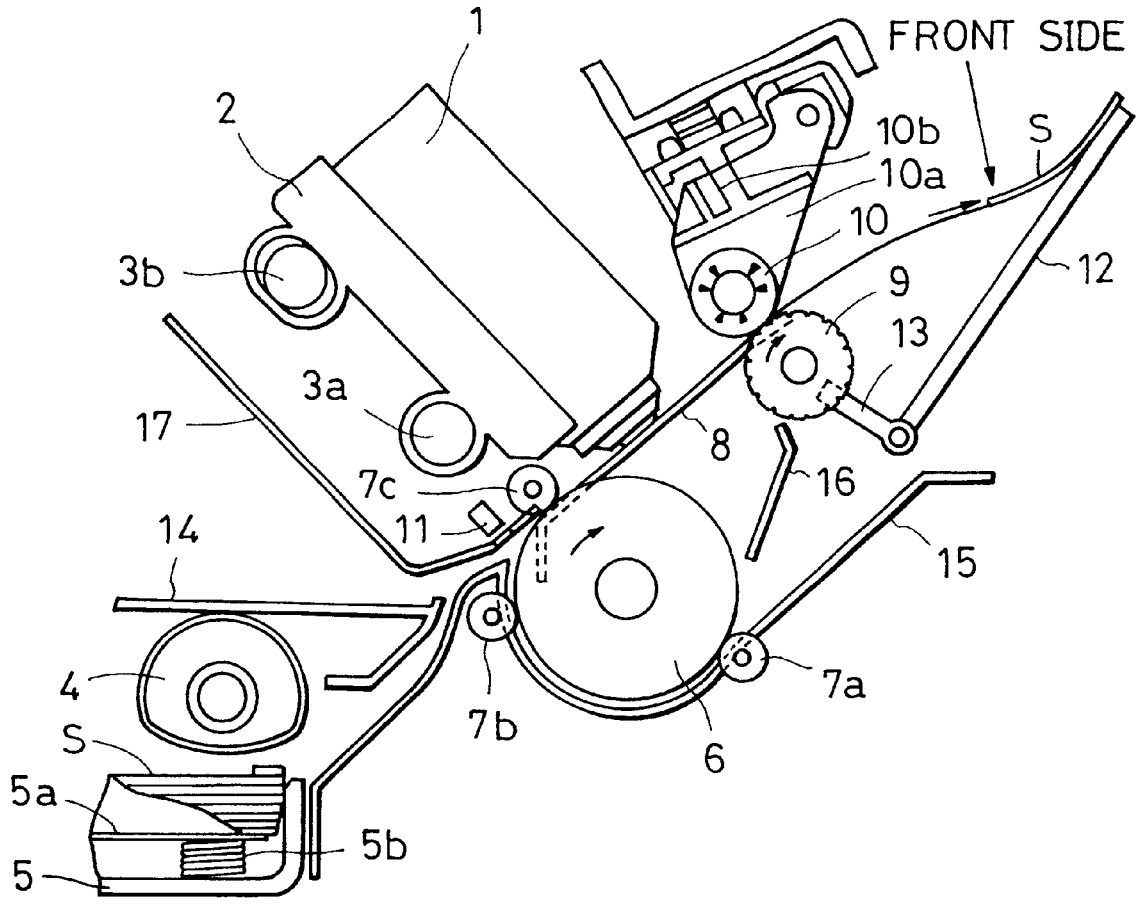

After that, Steps S202 and S203 described above are repeated until the rear end of the recording sheet S is detected by the sheet sensor 11, as shown in FIG. 9. In a case in which an ejection command is input from the host computer 24 during the processing (S204), Step S212 is performed, that is, the recording sheet S is ejected. If the ejection command is not input, it is determined whether the rear end of the recording sheet is detected by the sheet sensor 11 (S205) and, if so, the feed amount L is set to 0. From the time when the rear end of the recording sheet S is detected by the sheet sensor (S205) until the sheet feeding amount L in the sub-scanning direction exceeds a predetermined amount L2, steps similar to Steps S202 and 203 are repeated in order to perform recording to the rear end of the sheet S (S208 and S209). In a case in which an ejection command is input from the host computer 24 during the processing S210, Step S212 is performed. After each recording operation is carried out in Step S209, the feeding amount L is increased by Ln, if no ejection command is input. When the feeding amount L reaches or exceeds the predetermined amount L2, it is determined that the recording on the front side is completed (S207), and Step S212 is performed.

Figure 10:
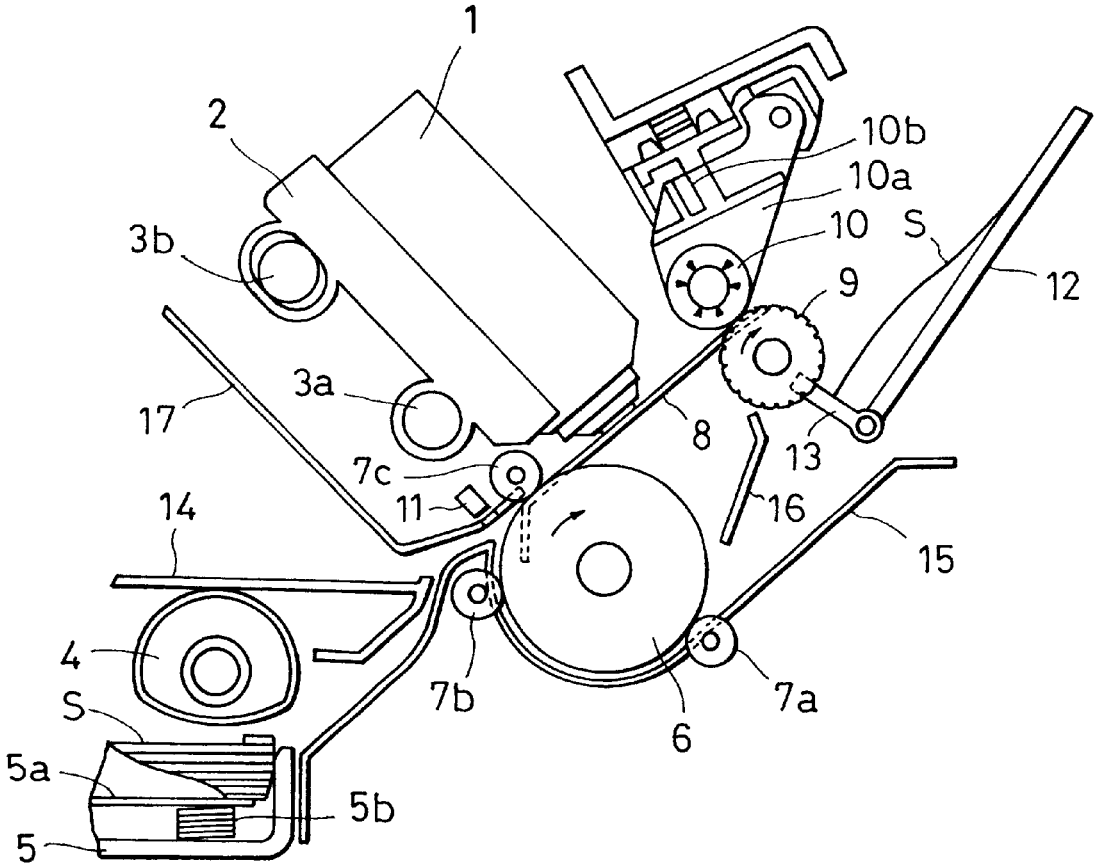

The recording sheet S, whose front side has been subjected to recording, is temporarily ejected onto the holding tray 12, as shown in FIG. 10 (S212).

Figure 11:
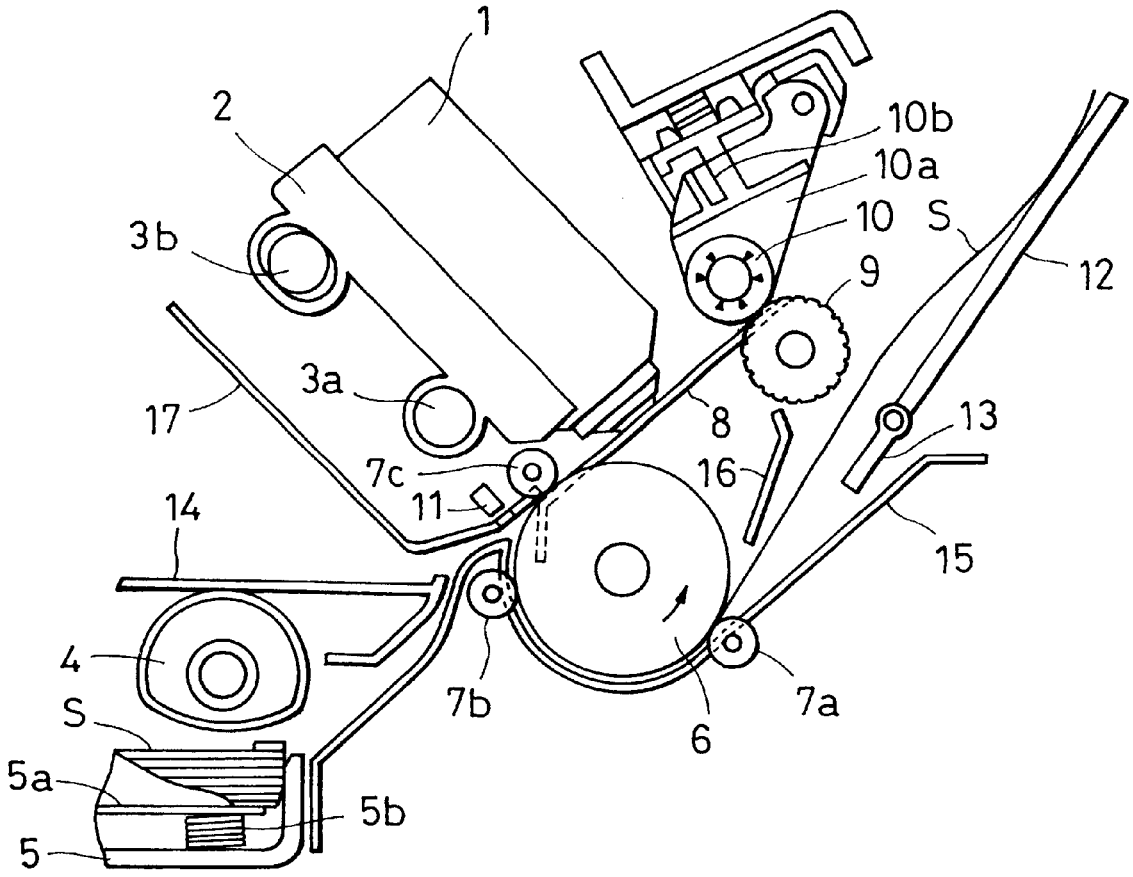

Next, a description will be given of an operation of turning the recording sheet S upside down. While the feed roller 6 is rotated in the opposite direction from the normal rotating direction by rotating the LF motor 28 in reverse, the solenoid 18*a* in the above-described opening and closing mechanism 18 is energized to open the bottom plate 13 of the holding tray 12 (S213). When the bottom plate 13 is opened, the recording sheet S, which has been ejected before, falls into the path defined by the guide plates 15 and 16, and the bottom end of the recording sheet S reaches the contact point between the feed roller 6 and the driven roller 7*a*, as shown in FIG. 11. Since the feed roller 6 is rotating in reverse at this time, the bottom end of the recording sheet S is regulated by the contact point between the feed roller 6 and the driven roller 7*a*, and is thereby positioned so as to be in parallel with the main scanning direction, that is, so as not to be inclined. There are no special limitations to the method of feeding the sheet from the holding tray 12 without skewing. For example, the holding tray 12 may be provided with a guide member for positioning both widthwise side edges of the sheet S so that the sheet S falls along the guide member.

Figure 12:
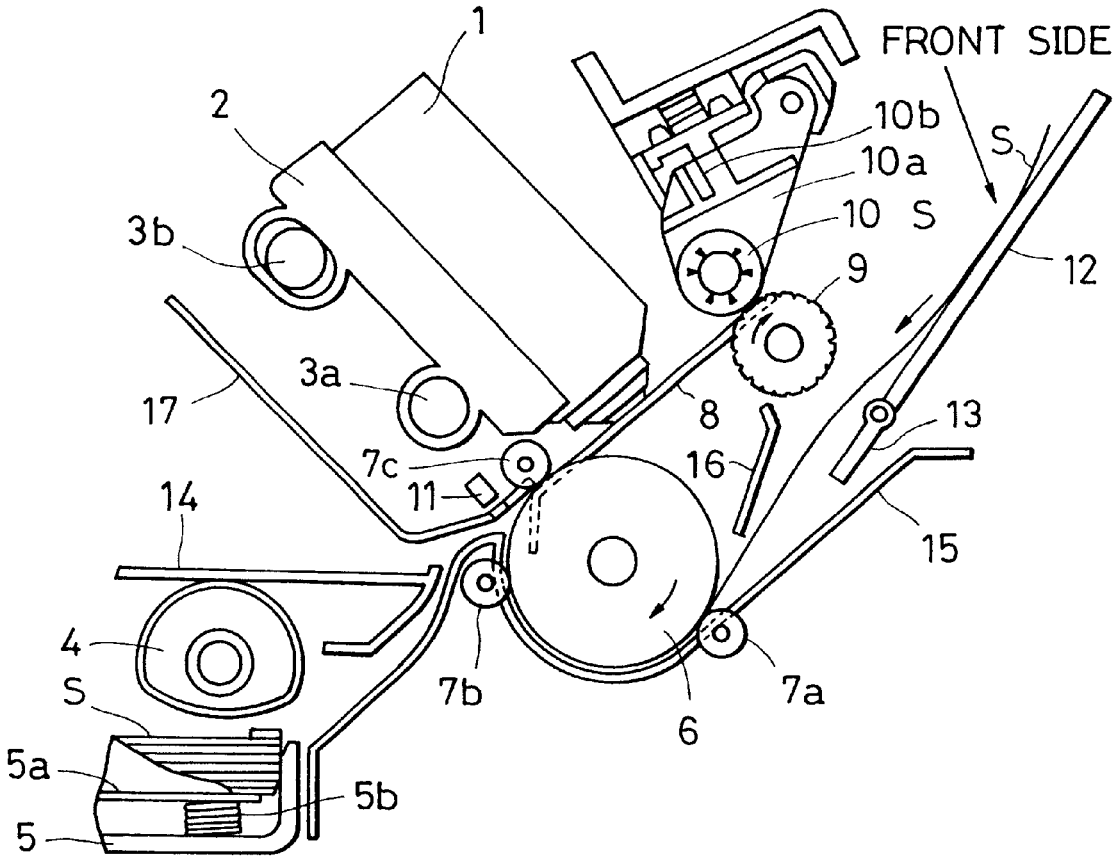
Figure 13:
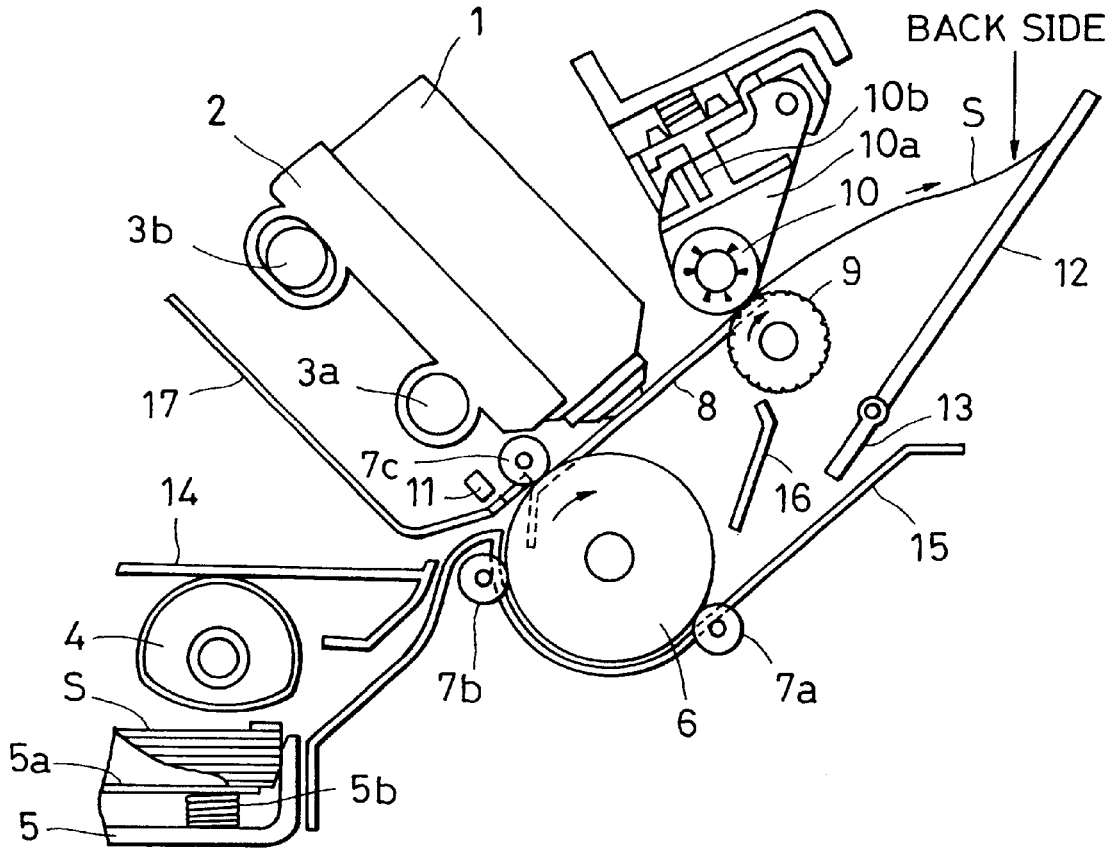

Next, a description will be given of an operation of calculating the length La of the recording sheet S in the sub-scanning direction. The feed roller 6 is rotated forward by rotating the LF motor 28 forward, thereby conveying the recording sheet S whose front side has been subjected to recording, as shown in FIG. 12 (S214). When the leading end (bottom end) of the recording sheet S in the feeding direction is detected by the sheet sensor 11 (S215), the number of drive pulses of the feed roller 6 is counted until the rear end (top end) of the recording sheet S is detected, whereby the total length La of the recording sheet S in the sub-scanning direction is calculated (S216 to S218). After determining the total length La of the recording sheet S is completed, when data is not received from the host computer 24, Step S227 is performed (S219).

When data is received, the feed roller 6 is rotated forward by driving the LF motor 28 forward, the recording sheet S is conveyed by a preset amount Ls and is placed into a back side recording start position, as shown in FIG. 12 (S220) and the feeding amount G in the sub-scanning direction is set to 0. The preset amount Ls is shorter than the distance from the contact point between the feed roller 6 and the driven roller 7*c*, and the sheet sensor 11.

Figure 14:
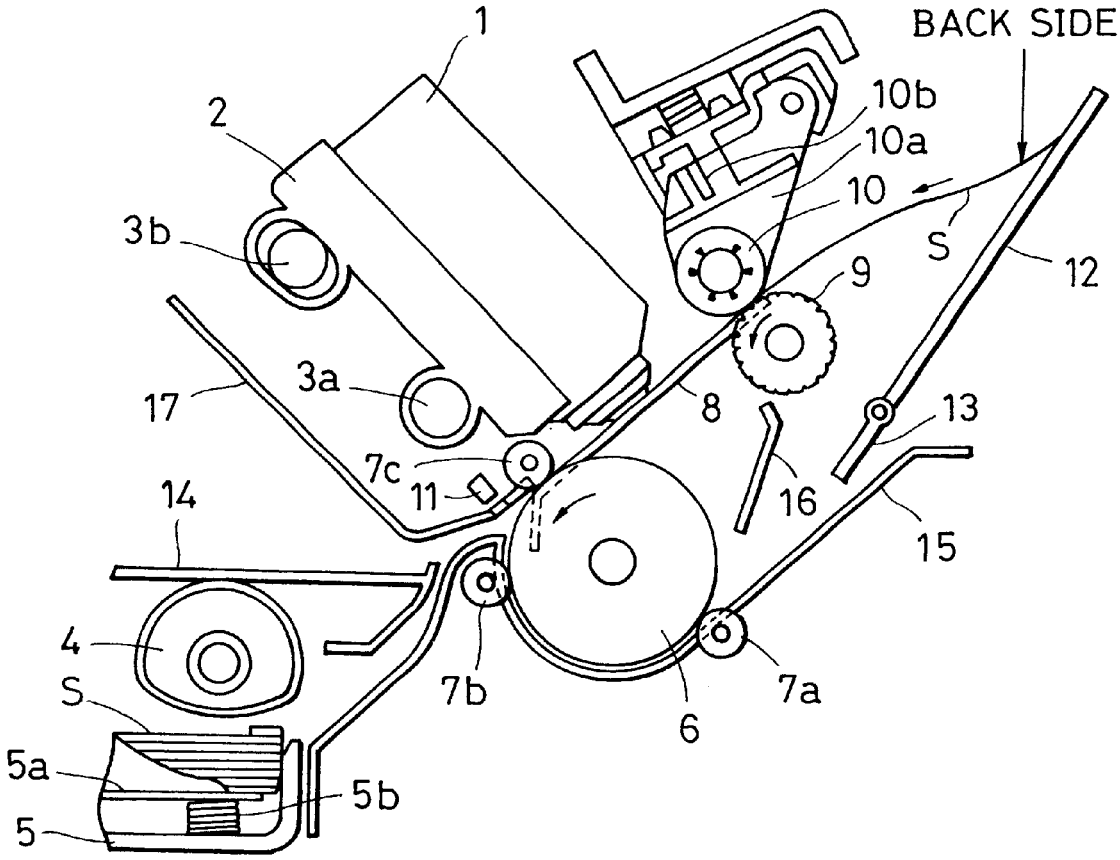

After the received data is expanded as recording data, the positions of the orifices used for recording are reversed to those in front-side recording so that the data is recorded from the dot in the M-th column and the H-th row, as shown in FIG. 5 (S222). That is, data is reversed both in the column direction and the row direction, as shown in FIG. 5, so that data in the M-th column and the H-th row is the first dot information for the first orifice, data in the M-th column and the H-1-th row is the first dot information for the second orifice, data in the M-th column and the H-2-th row is the first dot information for the third orifice, and so on. Then, as shown in FIG. 14, the feed roller 6 is rotated in reverse by driving the LF motor 28 in reverse, and the recording sheet S is conveyed with the top end thereof serving as the leading end in the feeding direction. That is, the recording sheet S is conveyed by the predetermined feeding amount Ln in the sub-scanning direction opposite from the normal feeding direction, and the recording head 1 operates in a manner similar to the above-described recording operation (see FIG. 7). Operations in Steps S222 to S225 are repeated until the sum of the feeding amount G in the sub-scanning direction, the preset leading margin Ls, and the rear margin Lu exceeds the length La of the recording sheet S calculated before.

Figure 15:
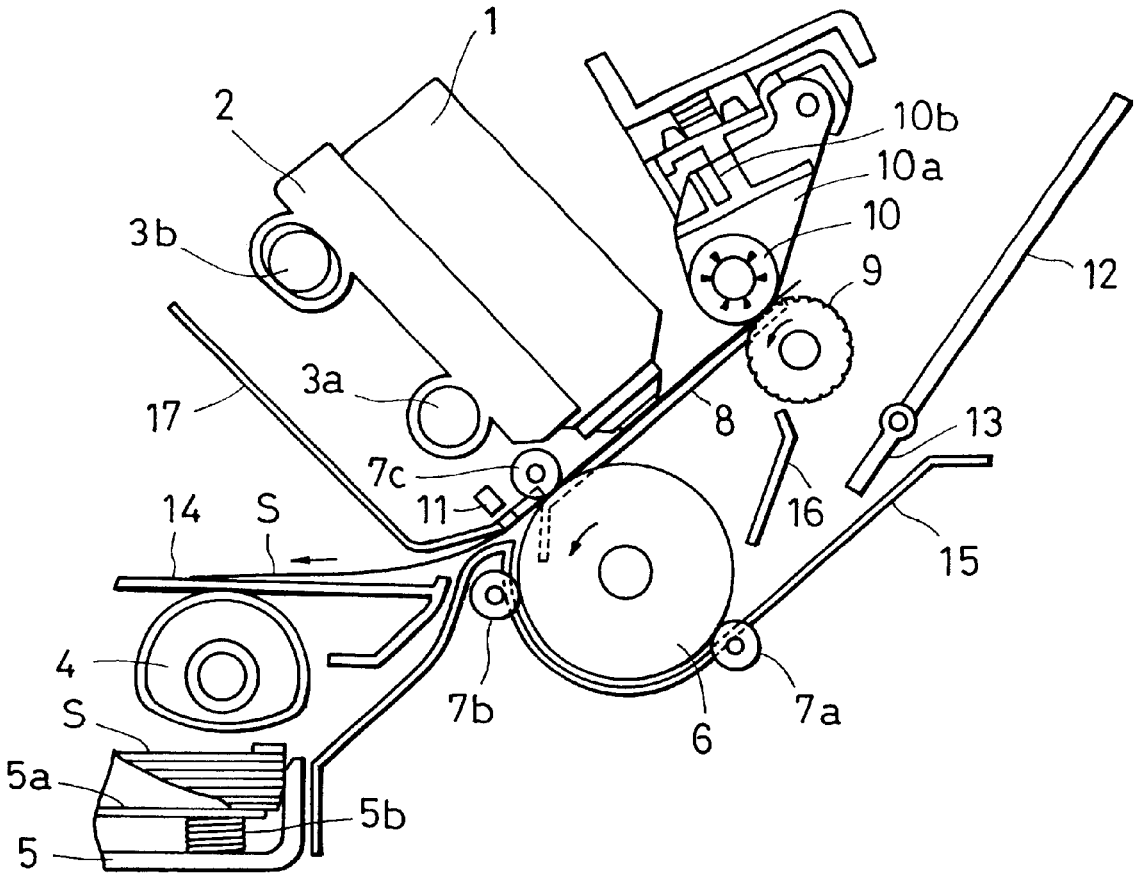

When the sum becomes equal to or more than the sheet length La calculated before (S226), the feed roller 6 is rotated in reverse by rotating the LF motor 28 in reverse, as shown in FIG. 14, and the recording sheet S with both sides recorded is ejected onto the ejection tray 14, as shown in FIG. 15 (S227). Subsequently, the solenoid 18*a* of the opening and closing mechanism 18 is de-energized to close the bottom plate 13 of the holding tray 12 (S228). When received data still remains, Step S201 is performed again, and the routine up to Step S229 is similarly repeated.

In a normal recording mode (single-sided recording mode), the bottom plate 13 of the holding tray 12 is kept closed (in the state shown in FIG. 10), and a series of recording operations are completed when the recording sheet S is ejected onto the holding tray 12. In this case, the recording operations may be completed when the bottom end of the recording sheet S is conveyed to the ejection tray 14 by rotating the ejection roller 9 and the feed roller 6 in reverse after the completion of front-side recording.

Next, a description will be given of the processing of sending recording data created and edited in the host computer or the like to the recording apparatus in double-sided recording according to this embodiment, with reference to the drawings.

Figure 16:
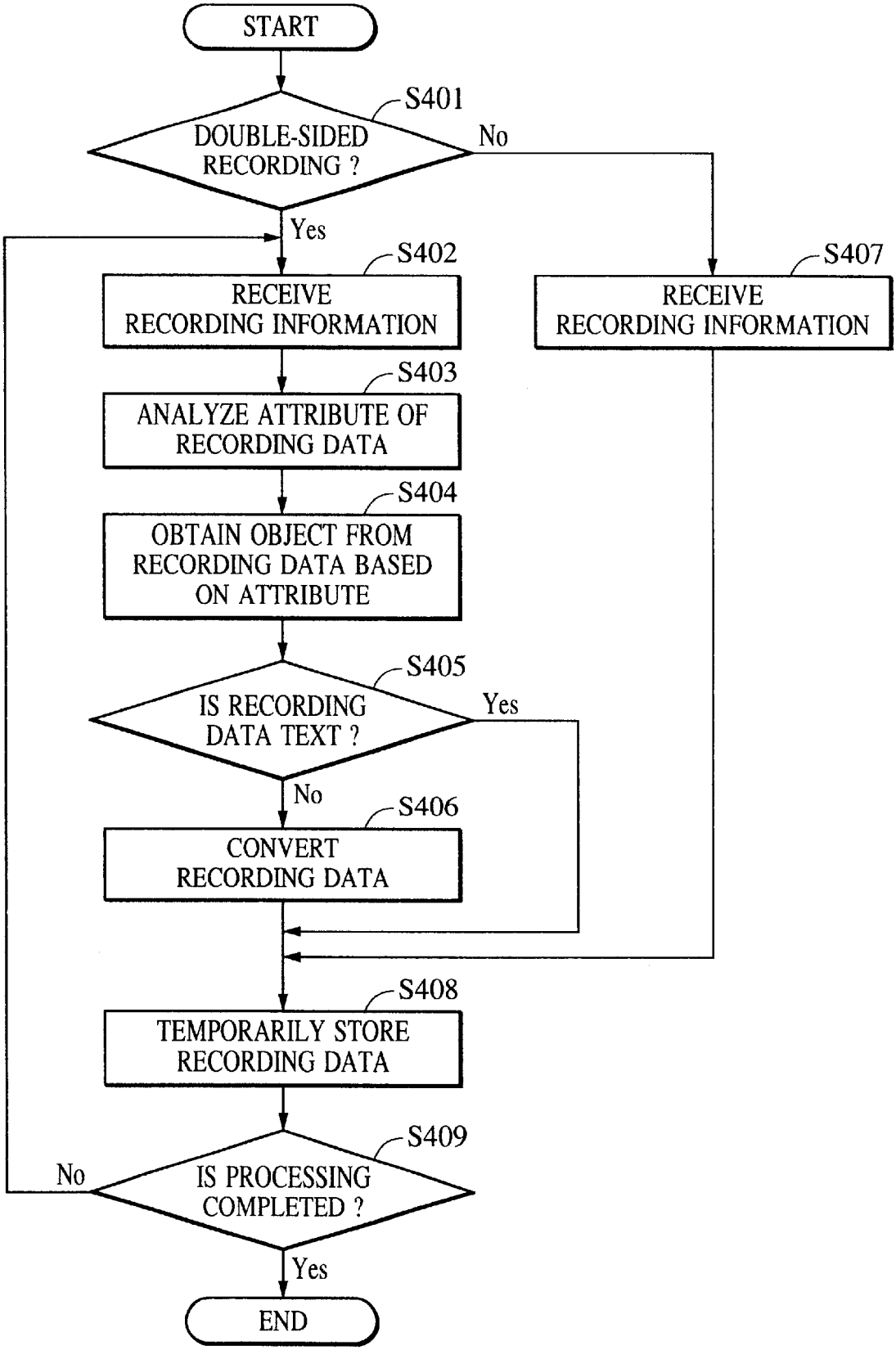
FIG. 16 is a flowchart showing recording data processing in the double-sided recording mode.

FIG. 16 is a flowchart showing an example of the processing. In this embodiment, the processing is carried out by the printer driver 31, and recording data created and edited in the host computer 24 is sent to the printer driver 31, together with information about various attributes of the data. The attribute information is formed based on the recording data, and includes, for example, information about the type, such as a text or an image, position, and color of an object to be formed based on the recording data.

The processing is carried out depending on the choice between double-sided recording and single-sided recording (S401). When single-sided recording is selected, recording data is received from the host computer 24 (S407), and is temporarily stored (S408). After this operation is repeated for all the recording data to be recorded, the processing is completed (S409).

Figure 17:
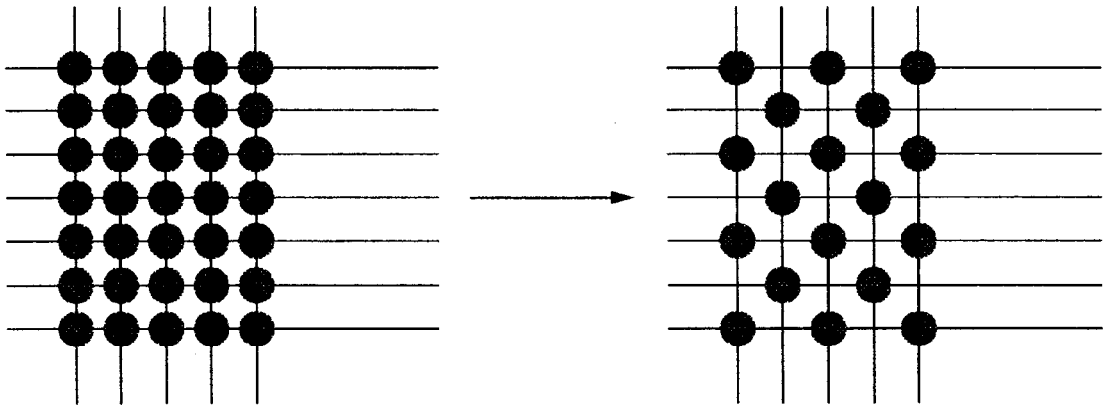
FIG. 17 is a schematic explanatory illustration showing recording data conversion in the double-sided recording mode.

When double-sided recording is selected, recording information is received (S402), and attribute information about recording data included in the recording information is analyzed (S403). Through such analysis of attribute information, the type of an object to be formed based on the recording head is obtained (S404). Next, it is determined whether or not the obtained type of the object is text (character) information (S405). When it is text information, the recording data is temporarily stored unchanged (S408). When it is determined in Step S405 that the object is not text, the recording data is subjected to conversion (S406). In this embodiment, as an example of conversion, the received recording data is thinned out to almost half. This conversion is schematically illustrated in FIG. 17. Subsequently, the converted data is temporarily stored as recording data to be recorded (S408). After these operations are repeated for all the recording data, the processing is completed. Then, the printer driver 31 transfers the recording data temporarily stored in Step S408 and a recording start command to the recording apparatus via the interface 23, whereby the recording apparatus starts a recording operation. While the converted data is temporarily stored for the whole of the conversion time in this embodiment, it may be transferred to the recording apparatus every time conversion is completed, without being stored.

Figure 18:
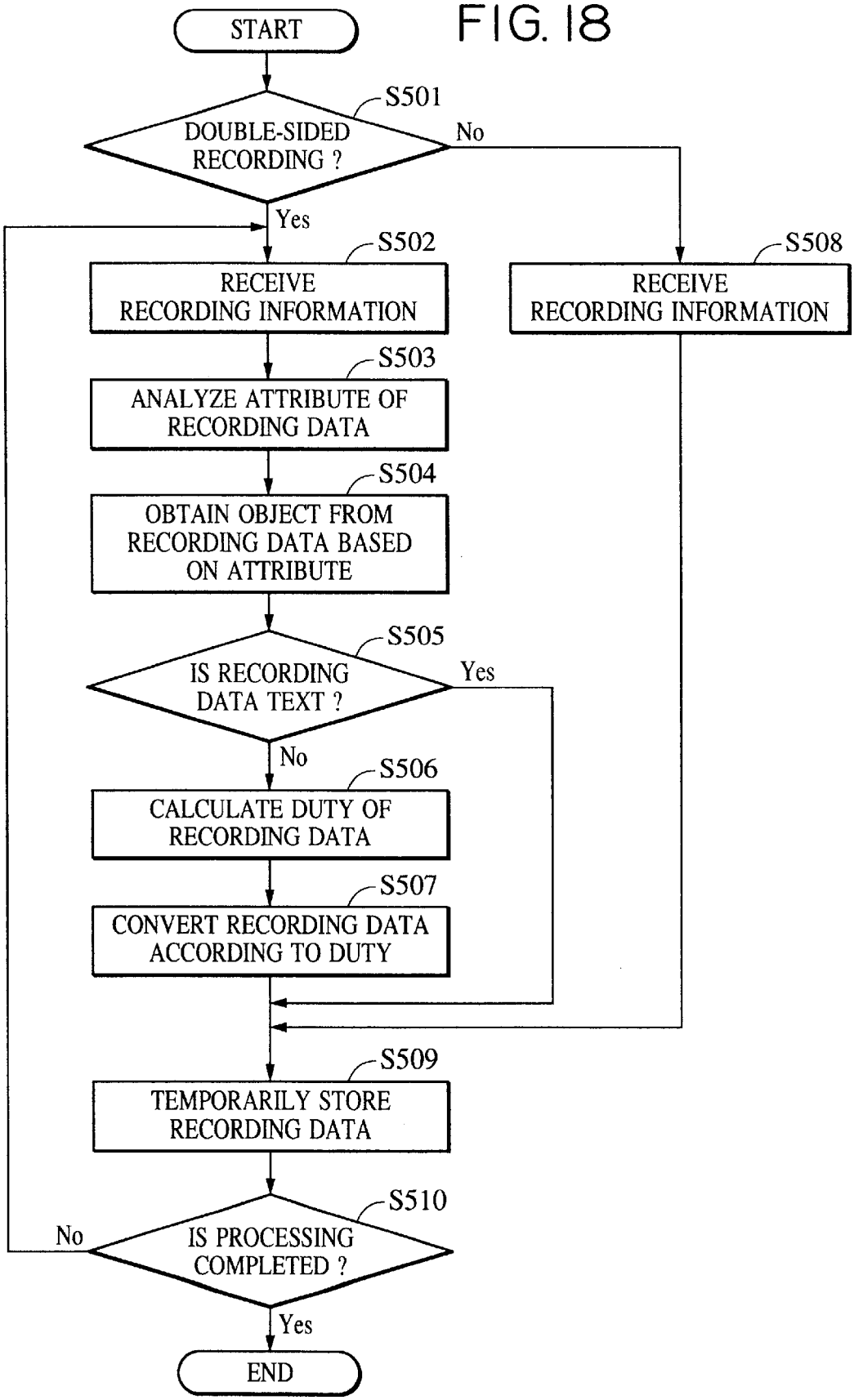
FIG. 18 is a flowchart showing another recording data processing in the double-sided recording mode.

When the type of the object of recording data is not text data, it may be possible to calculate the duty from the recording data and to convert the recording data in accordance with the duty. This processing is shown in FIG. 18. In FIG. 18, Steps S501–S504 and S508–S510 are similar to steps S401–S404 and S407–S409, respectively, in FIG. 16 and will not be described in detail herein.

In FIG. 18, when the type of the object is not text in Step S505, for example, the average recording duty within a predetermined region in the object or the like is calculated (S506). The recording duty means, for example, the ratio of dots formed in a predetermined region on a sheet S. Next, when the calculated duty is equal to or more than a predetermined duty, the thinning shown in FIG. 17 is carried out. When the calculated duty is less than the predetermined duty, conversion is carried out in accordance with the calculated duty, instead of thinning (S507). Subsequent operations (Steps S508–S510) are performed in a manner similar to the case shown in FIG. 16, and converted recording data is transferred to the recording apparatus. In Step S507, the thinning rate may be changed according to the calculated duty, for example, to approximately 50%. It is satisfactory as long as the thinning rate does not lower recording quality when double-sided recording is performed based on the converted recording data. For example, the thinning rate may be varied depending on the type of the sheet to be subjected to double-sided recording. In this case, the type of the sheet is designated on the host computer, and is sent as recording information to the printer driver 31. The printer driver 31 may vary the thinning rate in conversion, based on the recording information.

While thinning has been described above as an example of the method of converting recording data, recording data may be converted so as to reduce the size of ink droplets to be discharged from the recording head. In short, it is satisfactory that conversion can reduce the amount of ink to be applied on a predetermined area in the recording medium.

In this way, when recording data is not text, for example, when it is graphic data having a high recording duty, it is possible to prevent ink printed on one side from spreading on the other side by thinning out the recording data. Therefore, double-sided recording can be made while preventing the quality of recording on the recording sheet S from being reduced. In contrast, when the recording data is text data, since the recording duty is low in general, spreading does not occur, and conversion is not performed. This allows precise information transmission.

Second Embodiment

Next, a description will be given of other operations performed until recording data is transmitted to the recording apparatus. Herein, a method will be described, which detects data to be converted for double-sided recording based on position information in recording data, instead of the type of the object. This method is shown in FIG. 19.

Referring to FIG. 19, when double-sided recording is selected (S601), after recording information is received (S602), attribute information about recording data included in the recording information is analyzed in a manner similar to the above embodiment (S603). By analyzing the attribute information, position information about an object to be formed on the recording data is obtained (S604), and is temporarily stored with the recording data (S605). These operations are carried out for all recording data to be recorded on both sides of a sheet S (S606).

Subsequently, recording data overlapping on both sides of the sheet S is detected based on the obtained position information about the object (S607), and is subjected to conversion for double-sided recording in a manner similar to the above embodiment (S608). While the recording data on both sides is thinned out in this embodiment, thinning may be performed only for recording data on one side. The converted recording data is temporarily stored (S610), and all the recording data detected in Step S607 is subjected to conversion. Then, the processing is completed (S611).

If double-sided recording is not selected (S601), after recording information is received (S609), the process flows directly to step S610.

In Step S604, it may be possible to also obtain information about color in addition to the position information about recording data, and to convert the recording data according to the position information and the color information. This processing is shown in FIG. 20.

Figure 20:
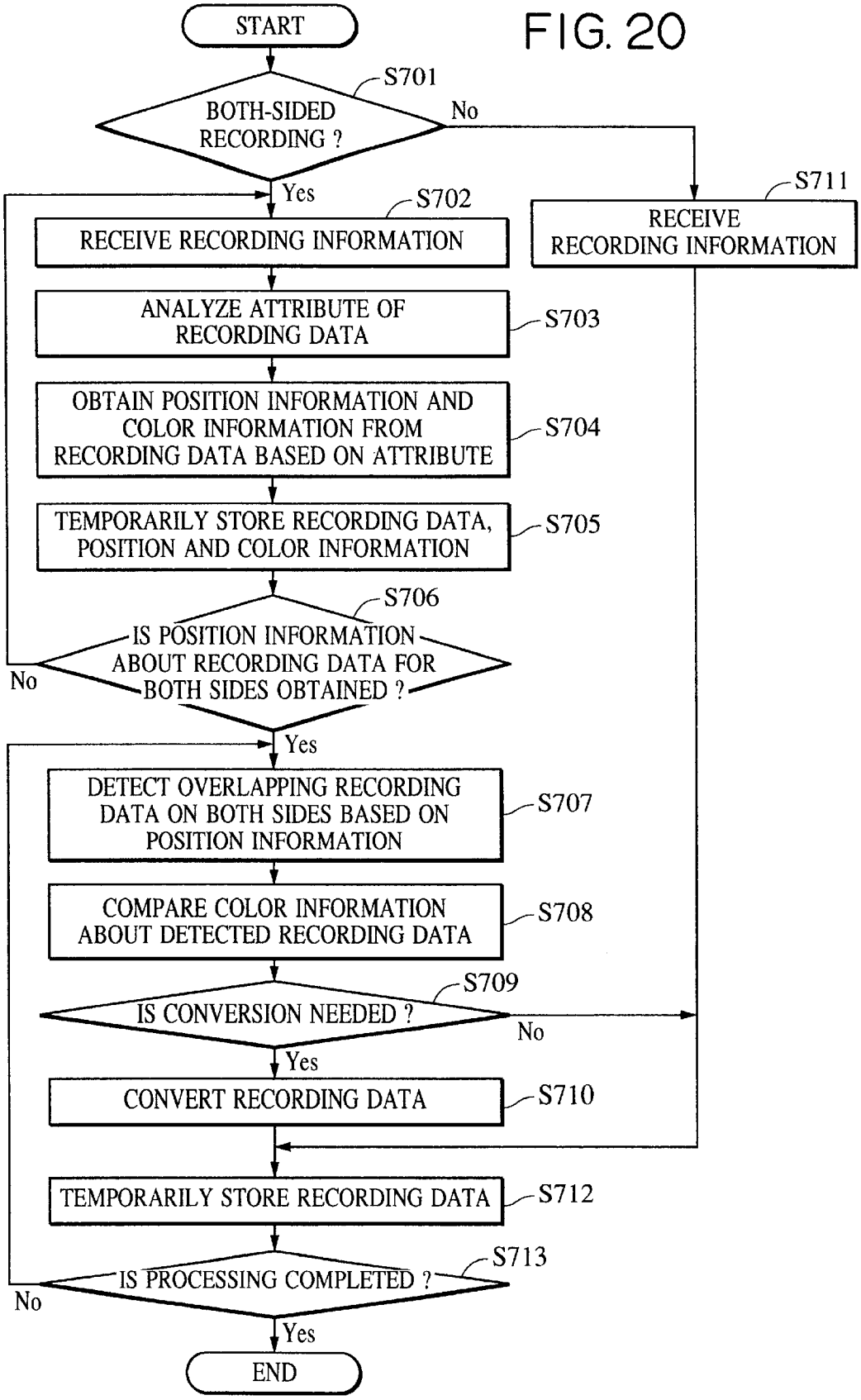
FIG. 20 is a flowchart showing another recording data processing in the double-sided recording mode according to the second embodiment.
Figure 21:
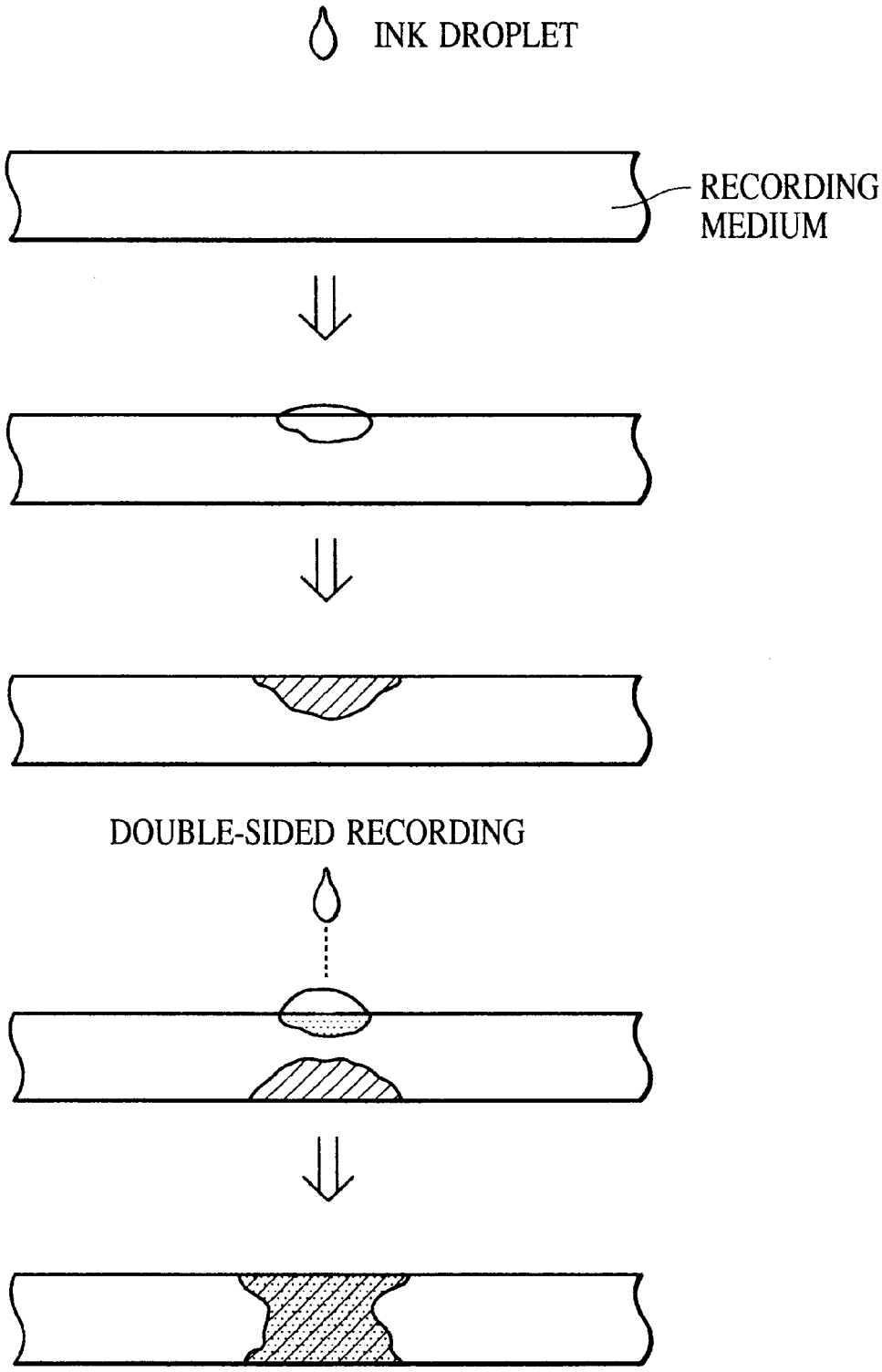
FIG. 21 is an explanatory illustration showing the state of ink in double-sided recording.

In FIG. 20, Steps S701 to S703 are the same as above. In Step S704, position information and color information about recording data are obtained. In a manner similar to above, the obtained position information and color information about recording data to be recorded on both sides of the sheet S are stored (S705, S706).

Subsequently, recording data overlapping on both sides of the sheet S are detected based on the position information about the recording data (S707), and color information about the detected recording data is compared. That is, of the recording data overlapping on both sides of the sheet S, color information about data recorded on one side and color information about data recorded on the other side are compared (S708). Next, it is determined whether or not to convert the recording data for double-sided recording, based on the result of comparison of color information (S709). When conversion is needed, it is carried out in Step S710. In Step S709, for example, it is determined that conversion is not necessary when both recording data are similar in tone, and that conversion is necessary when the tones thereof are substantially different. After conversion, operations similar to the above are performed (S712 and S713). The need for conversion is judged for all the recording data to be recorded, and conversion is performed. Then, data conversion for double-sided recording is completed.

In performing such processing, the recording apparatus includes a recording head capable of color recording. Various modifications are possible in determining whether to perform conversion in Step S709, and in converting recording data in Step S710. For example, it may be possible to calculate the difference in tone, and to change the thinning rate in accordance with the calculated value. It is preferable that the thinning rate be set to be equal to or more than 50% when the difference in tone is greater than a predetermined value, and that the thinning rate be set to be 10% when the difference in tone is smaller than a predetermined value. While it is determined whether to carry out conversion based only on color information about recording data in this embodiment, consideration may be given to the duty in a predetermined region, in addition to the color information. For example, when the tones are substantially different and the duty is equal to or less than a predetermined value, the thinning rate is set to be small. Conversely, even when the difference in tone is small and the duty exceeds the predetermined value, the thinning rate is set to be large. Furthermore, it is more preferable that consideration be given to the type of a sheet serving as a recording medium, in addition to color information and the duty.

In this way, when recording data on both sides overlap, it is thinned out, and furthermore, is thinned out in consideration of color information and medium information. Since this prevents the ink applied on one side from spreading to the other side, double-sided recording can be made while preventing reduction in quality of recording on the sheet. In double-sided recording, recording data on the sheet is not converted in its entirety, but is selectively converted. Therefore, the reduction in recording quality due to conversion is minimized, which allows good double-sided recording.

The present invention is not to be limited to a system in which printer driver 31 is installed in host computer 24. The invention is also applicable to a system in which CPU 19 of the recording apparatus performs the functions of the printer driver. In that case, CPU 19 converts recording data in double-sided recording and detects data to be converted.

As described above, according to the present invention, recording can be made on both sides of a recording medium, such as a sheet, while the reduction in recording quality due to spreading of ink and conversion of recording data is minimized.

The present invention is particularly suitable for use in an ink jet recording head and recording apparatus wherein thermal energy generated by an electrothermal transducer, a laser beam or the like is used to cause a change of state of the ink to eject or discharge the ink. This is because high density of the picture elements and high resolution of the recording are possible.

The typical structure and the operational principle of such devices are preferably the ones disclosed in U.S. Pat. Nos. 4,723,129 and 4,740,796. The principle and structure are applicable to a so-called on-demand type recording system and a continuous type recording system. Particularly, however, it is suitable for the on-demand type because the principle is such that at least one driving signal is applied to an electrothermal transducer disposed on a liquid (ink) retaining sheet or liquid passage, the driving signal being enough to provide such a quick temperature rise beyond a departure from nucleation boiling point, by which the thermal energy is provided by the electrothermal transducer to produce film boiling on the heating portion of the recording head, whereby a bubble can be formed in the liquid (ink) corresponding to each of the driving signals. By the production, development and contraction of the bubble, the liquid (ink) is ejected through an ejection outlet to produce at least one droplet. The driving signal is preferably in the form of a pulse, because the development and contraction of the bubble can be effected instantaneously, and therefore, the liquid (ink) is ejected with quick response. The driving signal in the form of the pulse is preferably such as disclosed in U.S. Pat. Nos. 4,463,359 and 4,345,262. In addition, the temperature increasing rate of the heating surface is preferably such as disclosed in U.S. Pat. No. 4,313,124.

The structure of the recording head may be as shown in U.S. Pat. Nos. 4,558,333 and 4,459,600 wherein the heating portion is disposed at a bent portion, as well as the structure of the combination of the ejection outlet, liquid passage and the electrothermal transducer as disclosed in the above-mentioned patents. In addition, the present invention is applicable to the structure disclosed in Japanese Laid-Open Patent Application No. 123670/1984 wherein a common slit is used as the ejection outlet for plural electrothermal transducers, and to the structure disclosed in Japanese Laid-Open Patent Application No. 138461/1984 wherein an opening for absorbing pressure waves of the thermal energy is formed corresponding to the ejecting portion. This is because the present invention is effective to perform the recording operation with certainty and at high efficiency regardless of the type of recording head.

In addition, the present invention is applicable to a serial type recording head wherein the recording head is fixed on the main assembly, to a replaceable chip type recording head which is connected electrically with the main apparatus and which can be supplied with the ink when it is mounted in the main assembly, or to a cartridge type recording head having an integral ink container.

The provisions of recovery means and/or auxiliary means for the preliminary operation are preferable, because they can further stabilize the effects of the present invention. Examples of such means include a capping means for the recording head, cleaning means therefore, pressurizing or suction means, and preliminary heating means which may be the electrothermal transducer, an additional heating element or a combination thereof. Also, means for effecting preliminary ejection (not for the recording operation) can stabilize the recording operation.

As regards the variation of the recording head mountable, it may be a single head corresponding to a single color ink, or may be plural heads corresponding to a plurality of ink materials having different recording colors or densities. The present invention is effectively applied to an apparatus having at least one of a monochromatic mode mainly with black, a multi-color mode with different color ink materials and/or a full-color mode using the mixture of the colors, which may be an integrally formed recording unit or a combination of plural recording heads.

Furthermore, in the foregoing embodiments, the ink has been liquid. It also may be ink material which is solid below room temperature but liquid at room temperature. Since the ink is kept within a temperature between 30° C. and 70° C., in order to stabilize the viscosity of the ink to provide the stabilized ejection in the usual recording apparatus of this type, the ink may be such that it is liquid within the temperature range when the recording signal is applied. The present invention is applicable to other types of ink. In one of them, the temperature rise due to the thermal energy is positively prevented by consuming it for the state change of the ink from the solid state to the liquid state. Another ink material is solidified when it is left unused, to prevent the evaporation of the ink. In either of the cases, in response to the application of the recording signal producing thermal energy, the ink is liquefied, and the liquefied ink may be ejected. Another ink material may start to be solidified at the time when it reaches the recording material.

The present invention is also applicable to such an ink material as is liquefied by the application of the thermal energy. Such an ink material may be retained as a liquid or solid material in through-holes or recesses formed in a porous sheet as disclosed in Japanese Laid-Open Patent Application No. 56847/1979 and Japanese Laid-Open Patent Application No. 71260/1985. The sheet is faced to the electrothermal transducers. The most effective one of the techniques described above is the film boiling system.

The ink jet recording apparatus may be used as an output terminal of an information processing apparatus such as a computer or the like, as a copying apparatus combined with an image reader or the like or as a facsimile machine having information sending and receiving functions.

The individual components shown in outline or designated by blocks in the drawings are well-known in the image recording art and their specific construction and operation are not critical to the operation or best mode for carrying out the invention.

While the invention has been described with reference to the structures disclosed herein, it is not confined to the details set forth and this application is intended to cover such modifications or changes as may come within the purposes of the improvements or the scope of the following claims.

What is claimed is:

1. An ink jet recording apparatus for performing recording by discharging ink from a recording head onto a recording medium based on recording data by using either of a single-side mode for effecting recording on only one side of the recording medium and a both-sides mode for effecting recording on both sides of the recording medium, said ink jet recording apparatus comprising:

conversion means for converting at least a part of the recording data when the both-sides mode is selected;

detection means for detecting recording data to be converted by said conversion means based on recording information including the recording data and an attribute of the recording data, wherein the detection by said detection means is performed when the both-sides mode is selected; and control means for controlling performing of recording based on at least the recording data converted by said conversion means according to the result of detection by said detection means when the both-sides mode is selected, and controlling performing of recording based on the recording data when the single-side mode is selected.

2. An ink jet recording apparatus according to claim 1, wherein said conversion means converts the recording data so as to reduce the amount of ink to be applied from said recording head onto a predetermined area of the recording medium.

3. An ink jet recording apparatus according to claim 2, wherein said conversion means converts the recording data by thinning.

4. An ink jet recording apparatus according to claim 2, wherein said conversion means converts the recording data so as to reduce the amount of ink to be discharged from said recording head.

5. An ink jet recording apparatus according to claim 1, wherein said detection means detects recording data to be converted by said conversion means according to the attribute of the recording data.

6. An ink jet recording apparatus according to claim 5, wherein said detection means detects recording data to be converted by said conversion means when the attribute of the recording data is an image and the duty of recording data in a predetermined region on at least one side of the recording medium is equal to or more than a predetermined value.

7. An ink jet recording apparatus according to claim 6, wherein said conversion means changes a conversion rate of converting recording data according to the duty of recording data in the predetermined region on at least one side of the recording medium when the attribute of recording data is an image.

8. An ink jet recording apparatus according to claim 7, wherein said conversion means changes the conversion rate of converting the recording data according to the type of the recording medium.

9. An ink jet recording apparatus according to claim 1, wherein said detection means detects recording data to be converted by said conversion means when the duty of recording data in a predetermined region on one side of the recording medium is equal to or more than a predetermined value.

10. An ink jet recording apparatus according to claim 1, wherein said detection means detects recording data to be converted by said conversion means based on position information of the recording data on one side of the recording medium and position information of the recording data on the other side thereof.

11. An ink jet recording apparatus according to claim 10, wherein said detection means detects recording data overlapping on one side and the other side of the recording medium as recording data to be converted by said conversion means.

12. An ink jet recording apparatus according to claim 11, wherein said conversion means converts recording data by thinning out recording data on one of the sides of the recording medium.

13. An ink jet recording apparatus according to claim 11, wherein said conversion means converts recording data by thinning out recording data on both sides of the recording medium.

14. An ink jet recording apparatus according to claim 10, wherein said detection means detects recording data to be converted by said conversion means according to color information based on recording data on one side of the recording medium and color information based on recording data on the other side.

15. An ink jet recording apparatus according to claim 14, wherein said detection means detects recording data to be converted by said conversion means when a difference in tone between recording data on one side of the recording medium and recording data on the other side is equal to or more than a predetermined value.

16. An ink jet recording apparatus according to claim 15, wherein said conversion means changes a conversion rate of converting recording data according to the difference in tone between recording data on one side of the recording medium and recording data on the other side.

17. An ink jet recording apparatus according to claim 16, wherein said conversion means changes the conversion rate of converting recording data according to the duty of recording data in a predetermined region on at least one side of the recording medium.

18. An ink jet recording apparatus according to claim 17, wherein said conversion means changes the conversion rate of converting the recording data according to the type of the recording medium.

19. An ink jet recording apparatus according to claim 1, wherein said ink jet recording apparatus selectively performs the single-side recording mode for effecting recording on only one side of the recording medium.

20. An ink jet recording apparatus according to claim 1, wherein said recording head discharges the ink by applying heat to the ink.

21. An ink jet recording method for performing recording by discharging ink from a recording head onto a recording medium based on recording data by using either of a single-side mode for effecting recording on only one side of the recording medium and a both-sides mode for effecting recording on both sides of the recording medium, said ink jet recording method comprising the steps of:

selecting recording in one of the single-side mode and the both-sides mode;

converting at least a part of the recording data when recording in the both-sides mode is selected in said selection step;

detecting recording data to be converted in said conversion step based on recording information including the recording data and an attribute of the recording data, wherein said detection step is performed when recording in the both-sides mode is selected in said selection step; and controlling performing of recording based on at least the recording data converted in said conversion step according to the detection result in said detection step when recording in the both-sides mode is selected in said selection step, and controlling performing of recording based on the recording data when recording in the single-side mode is selected in said selection step.

22. An ink jet recording method according to claim 21, wherein said conversion step converts the recording data so as to reduce the amount of ink to be applied from said recording head onto a predetermined area of the recording medium.

23. An ink jet recording method according to claim 22, wherein said conversion step converts the recording data by thinning.

24. An ink jet recording method according to claim 22, wherein said conversion step converts the recording data so as to reduce the amount of ink to be discharged from said recording head.

25. An ink jet recording method according to claim 21, wherein said detection step detects recording data to be converted in said conversion step according to the attribute of the recording data.

26. An ink jet recording method according claim 25, wherein said detection step detects recording data to be converted in said conversion step when the attribute of the recording data is an image and the duty of recording data in a predetermined region on at least one side of the recording medium is equal to or more than a predetermined value.

27. An ink jet recording method according to claim 26, wherein said conversion step changes a conversion rate of converting recording data according to the duty of recording data in the predetermined region on at least one side of the recording medium when the attribute of recording data is an image.

28. An ink jet recording method according to claim 27, wherein said conversion step changes the conversion rate of converting the recording data according to the type of the recording medium.

29. An ink jet recording method according to claim 21, wherein said detection step detects recording data to be converted in said conversion step when the duty of recording data in a predetermined region on one side of the recording medium is equal to or more than a predetermined value.

30. An ink jet recording method according to claim 21, wherein said detection step detects recording data to be converted in said conversion step based on position information of the recording data on one side of the recording medium and position information of the recording data on the other side thereof.

31. An inkjet recording method according to claim 30, wherein said detection step detects recording data overlapping on one side and the other side of the recording medium as recording data to be converted in said conversion step.

32. An ink jet recording method according to claim 31, wherein said conversion step converts recording data by thinning out recording data on one of the sides of the recording medium.

33. An ink jet recording method according to claim 31, wherein said conversion step converts recording data by thinning out recording data on both sides of the recording medium.

34. An ink jet recording method according to claim 30, wherein said detection step detects recording data to be converted in said conversion step according to color information based on recording data on one side of the recording medium and color information based on recording data on the other side.

35. An ink jet recording method according to claim 34, wherein said detection step detects recording data to be converted in said conversion step when a difference in tone between recording data on one side of the recording medium and recording data on the other side is equal to or more than a predetermined value.

36. An ink jet recording method according to claim 35, wherein said conversion step changes a conversion rate of converting recording data according to the difference in tone between recording data on one side of the recording medium and recording data on the other side.

37. An ink jet recording method according to claim 36, wherein said conversion step changes the conversion rate of converting recording data according to the duty of recording data in a predetermined region on at least one side of the recording medium.

38. An ink jet recording method according to claim 37, wherein said conversion step changes the conversion rate of converting the recording data according to the type of the recording medium.

39. An ink jet recording method according to claim 21, wherein said ink jet recording method selectively performs the single-side recording mode for effecting recording on only one side of the recording medium.

40. An ink jet recording method according to claim 21, wherein said recording head dischares the ink by applying heat to the ink.

41. An ink jet recording system for performing recording by discharging ink from a recording head onto a recording medium based on recording data by using either of a single-side mode for effecting recording on only one side of the recording medium and a both-sides mode for effecting recording on both sides of the recording medium, said ink jet recording system comprising:

a printer driver that detects recording data to be converted based on recording information including the recording data and an attribute of the recording data, wherein the detection is performed when the both-sides mode is selected, said printer driver converting the detected recording data; and a microprocessor that controls performing of recording based on at least the recording data converted by said printer driver according to the result of detection by said printer driver when the both-sides mode is selected, and controlling performing of recording based on the recording data when the single-side mode is selected.

42. An ink jet recording system according to claim 41, wherein said printer driver converts the recording data so as to reduce the amount of ink to be applied from said recording head onto a predetermined area of the recording medium.

43. An ink jet recording system according to claim 42, wherein said printer driver converts the recording data by thinning.

44. An ink jet recording system according to claim 41, wherein said printer driver detects recording data to be converted when the attribute of the recording data is an image and the duty of recording data in a predetermined region on at least one side of the recording medium is equal to or more than a predetermined value.

45. An ink jet recording system according to claim 44, wherein said printer driver changes a conversion rate of converting recording data according to the duty of recording data in the predetermined region on at least one side of the recording medium when the attribute of recording data is an image.

46. An ink jet recording system according to claim 45, wherein said printer driver changes the conversion rate of converting recording data according to the type of the recording medium.

47. An ink jet recording system according to claim 41, wherein said printer driver detects recording data to be converted when the duty of recording data in a predetermined region on one side of the recording medium is equal to or more than a predetermined value.

48. An ink jet recording system according to claim 41, wherein said printer driver detects recording data to be converted based on position information of the recording data on one side of the recording medium and position information of the recording data on the other side thereof.

49. An ink jet recording system according to claim 48, wherein said printer driver detects recording data overlapping on one side and the other side of the recording medium as recording data to be converted.

50. An ink jet recording system according to claim 49, wherein said printer driver converts recording data by thinning out recording data on one side of the sides of the recording medium.

51. An ink jet recording system according to claim 49, wherein said printer driver converts recording data by thinning out recording data on both sides of the recording medium.

52. An ink jet recording system according to claim 48, wherein said printer driver detects recording data to be converted according to color information based on recording data on one side of the recording medium and color information based on recording data on the other side.

53. An ink jet recording system according to claim 52, wherein said printer driver detects recording data to be converted when a difference in tone between recording data on one side of the recording medium and recording data on the other side is equal to or more than a predetermined value.

54. An ink jet recording system according to claim 53, wherein said printer driver changes a conversion rate of converting recording data according to the difference in tone between recording data on one side of the recording medium and recording data on the other side.

55. An ink jet recording system according to claim 54, wherein said printer driver changes the conversion rate of converting recording data according to the duty of recording data in a predetermined region on at least one side of the recording medium.

56. An ink jet recording system according to claim 55, wherein said printer driver changes the conversion rate of converting the recording data according to the type of the recording medium.

57. An ink jet recording system according to claim 41, wherein said recording head discharges the ink by applying heat to the ink.

58. A printer driver installed into a host computer which transfers recording data to an ink jet recording apparatus for performing recording by discharging ink from a recording head onto a recording medium based on recording data by using either of a single-side mode for effecting recording on only one side of the recording medium and a both-sides mode for effecting recording on both sides of the recording medium, wherein said printer driver detects recording data to be converted based on recording information including the recording data and an attribute of the recording data, wherein the detection is performed when the both-sides mode is selected, and said printer driver converts the detected recording data so that recording effected by said ink jet recording apparatus is controlled based on at least the recording data converted by said printer driver according to the result of detection by said printer driver when the both-sides mode is selected, and controlled based on the recording data when the single-side mode is selected.

* * * * *

UNITED STATES PATENT AND TRADEMARK OFFICE

CERTIFICATE OF CORRECTION

PATENT NO. : 6,752,481 B1
DATED : June 22, 2004
INVENTOR(S) : Takahashi et al.

It is certified that error appears in the above-identified patent and that said Letters Patent is hereby corrected as shown below:

Title page,
Item [75], Inventors, "Hara-machi (JP)" should read -- Tokyo (JP) --.
Item [56], References Cited, FOREIGN PATENT DOCUMENTS, "JP 40817491 A *" should read -- JP 8-174919 * --.

Column 16,
Line 66, "dischares" should read -- discharges --.

Signed and Sealed this

Fourteenth Day of June, 2005

JON W. DUDAS
*Director of the United States Patent and Trademark Office*